US008556256B2

(12) United States Patent
Ito

(10) Patent No.: US 8,556,256 B2
(45) Date of Patent: Oct. 15, 2013

(54) IMAGE FORMING APPARATUS HAVING CLUTCH ASSEMBLY

(75) Inventor: Yoichi Ito, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/547,563

(22) Filed: Jul. 12, 2012

(65) Prior Publication Data

US 2013/0020753 A1 Jan. 24, 2013

(30) Foreign Application Priority Data

Jul. 19, 2011 (JP) ..... 2011-158222

(51) Int. Cl.
*B65H 29/60* (2006.01)
*B65H 15/00* (2006.01)

(52) U.S. Cl.
CPC ..... *B65H 15/00* (2013.01); *Y10S 271/902* (2013.01)
USPC ..... 271/186; 271/902; 399/401

(58) Field of Classification Search
USPC ..... 271/225, 186, 902; 399/401
See application file for complete search history.

(56) References Cited

U.S. PATENT DOCUMENTS

| | | | | |
|---|---|---|---|---|
| 7,434,927 | B2 | 10/2008 | Sakuma et al. | |
| 7,591,551 | B2 | 9/2009 | Imoto et al. | |
| 7,828,290 | B2 * | 11/2010 | Muratani | 271/225 |
| 8,002,377 | B2 | 8/2011 | Kogure et al. | |
| 2001/0005463 | A1 * | 6/2001 | Blackman | 399/401 |
| 2010/0026758 | A1 | 2/2010 | Tanaka et al. | |
| 2010/0061745 | A1 | 3/2010 | Ito et al. | |
| 2010/0067938 | A1 | 3/2010 | Kemma et al. | |
| 2010/0207990 | A1 | 8/2010 | Ito et al. | |
| 2011/0141181 | A1 | 6/2011 | Ito et al. | |
| 2012/0056932 | A1 | 3/2012 | Matsubara et al. | |
| 2012/0062648 | A1 | 3/2012 | Tanaka et al. | |
| 2012/0081487 | A1 | 4/2012 | Tanaka et al. | |
| 2012/0113180 | A1 | 5/2012 | Tanaka et al. | |
| 2012/0113204 | A1 | 5/2012 | Tanaka et al. | |
| 2012/0155916 | A1 | 6/2012 | Ito et al. | |
| 2012/0161382 | A1 * | 6/2012 | Morinaga et al. | 271/225 |

FOREIGN PATENT DOCUMENTS

| | | |
|---|---|---|
| JP | 5-107969 | 4/1993 |
| JP | 10-291709 | 11/1998 |
| JP | 2004-276425 | 10/2004 |

(Continued)

OTHER PUBLICATIONS

U.S. Appl. No. 13/456,344 of Kuniyori Takano, filed Apr. 26, 2012 (including specification, claims, abstract and drawings).

*Primary Examiner* — Gerald McClain
(74) *Attorney, Agent, or Firm* — Cooper & Dunham LLP

(57) ABSTRACT

An image forming apparatus includes a conveyance device to convey a sheet, an image forming device disposed opposing the conveyance device, a switchback device downstream from the conveyance device to switch hack the sheet after image formation a first face of the sheet on an opposing surface of the conveyance device, a refeeding device to refeed the sheet switched back, a reverse path to guide the sheet to a non-opposing, surface of the conveyance device, reverse the sheet, and guide the sheet to the opposing surface again, a single driving source to drive the conveyance device and the switchback device, a driving assembly to transmit driving force of the driving source to the conveyance device, a clutch assembly disposed at a position other than the driving assembly to switch rotation of the switchback device between forward rotation and reverse rotation, and an activation device to activate the clutch assembly.

12 Claims, 9 Drawing Sheets

(56) References Cited

FOREIGN PATENT DOCUMENTS

| | | |
|---|---|---|
| JP | 2005-148365 | 6/2005 |
| JP | 2006-232440 | 9/2006 |
| JP | 2007-76881 | 3/2007 |
| JP | 2008-285279 | 11/2008 |

* cited by examiner

IMAGE FORMING APPARATUS HAVING CLUTCH ASSEMBLY

CROSS-REFERENCE TO RELATED APPLICATION

This patent application is based on and claims priority pursuant to 35 U.S.C. §119 to Japanese Patent Application No. 2011-158222, filed on Jul. 19, 2011 in the Japan Patent Office, the entire disclosure of which is hereby incorporated by reference herein.

BACKGROUND

1. Technical Field

This disclosure relates to an image forming apparatus, and more specifically to an image forming apparatus, such as an inkjet recording apparatus, copier, printer, facsimile machine, plotter, or printing device, having a clutch assembly to perform drive switching to switch back a sheet at a position downstream from an image forming device.

2. Description of the Related Art

For image forming apparatuses capable of performing duplex printing (printing images on both front and back faces of a sheet of recording media), the drive switching for switching back the sheet is performed by (1) an additional actuator, such as a clutch, or (2) a pivoting gear. In an example of the drive switching performed by (1) a clutch or additional actuator, a duplex-printing transport switching section (switchback mechanism) to transport a sheet to a duplex-printing transport path after image formation is disposed downstream from an image forming section (including a fixing device). After image formation on a first face of a sheet, the sheet is switched back by a sheet output section and transported into the duplex printing transport path (see, for example, JP-2008-285279 and JP-2007-076881).

In JP-2008-285279 and JP-2007-076881, a clutch having a solenoid serving as additional actuator (a combination of a pivoting gear and a link mechanism or a combination of a pivoting gear and a switching guide) and its driving connection method are proposed to obviate driving sources rotatable in forward and reverse directions and perform the switchback operation by a single driving source.

In an example of the drive switching performed by (2) a pivoting gear, in an image forming apparatus that conveys a sheet by a conveyance belt and forms an image on the sheet on the conveyance belt, a duplex transport path switching section to transport a sheet to a duplex transport path (duplex transport route) after image formation is disposed upstream from an image forming section. After the end of printing (image formation) on a first face of the sheet, the sheet is switched hack by the driving of the conveyance belt in reverse direction and is transported into the duplex transport path.

For such a configuration, the sheet is always reversed in the duplex transport path, and the surface of the conveyance belt is rotated in both forward and reverse directions to convey the sheet. Hence, as an art to drive with a single driving source, for example, JP-2005-148365-A proposes to connect driving of the duplex transport path via a pivoting gear without a clutch.

However, for conventional arts, including the arts described in JP-2008-285279 and JP-2007-076881, in which the drive switching for switching back the sheet is performed by an additional actuator, such as a clutch, the size and cost of the image forming apparatus may increase.

For a driving connection method using a pivoting gear (including the art described in JP-2005-148365-A), a duplex transport path switching section to transport a sheet to a duplex transport path after image formation is disposed downstream from an image forming section. A duplex transport path is formed to switch back the sheet at a sheet output section after an image is formed on a first face of the sheet and guide the sheet having the image on the first face to a non-opposing face of a conveyance belt not opposing an image forming device or a non-opposing side of a conveyance roller not opposing the image forming device. In such a case, if a pivoting gear is used, the pivoting gear is disposed in a driving system connected to the conveyance roller, thus hampering high-speed control of the conveyance belt or high-precision and high-speed control of the transport amount of the sheet conveyed by the conveyance belt (e.g., a transport amount control to determine the position of the sheet in unit of micrometer in several tens of milliseconds).

In addition, typically, a direct current (DC) motor is used as the driving source. If the pivoting gear is intermediately disposed in the driving system from the DC motor to the conveyance roller to drive the conveyance belt via a driving force transmission device, e.g., a timing belt, the intermediation of the pivoting gear reduces the driving stiffness of the driving system. Alternatively, when a high frequency is input to drive the DC motor, the DC motor may oscillate or increase the time constant. Consequently, since only a low frequency can be input to the DC motor, the activation of the DC motor may slow, thus hampering high-speed control of the conveyance belt or high-precision and high-speed control of the sheet transport amount.

BRIEF SUMMARY

In an aspect of this disclosure, there is provided an image forming apparatus including a conveyance device, an image forming device, a switchback device, a refeeding device, a reverse path, a single driving source, a driving assembly, a clutch assembly, and an activation device. The conveyance device conveys a sheet of recording media. The image forming device is disposed opposing the conveyance device to form an image on the sheet conveyed by the conveyance device. The switchback device is rotatable in forward and reverse directions and disposed downstream from the conveyance device to switch back the sheet after the image forming device forms an image on a first face of the sheet on an opposing surface of the conveyance device opposing the image forming device. The refeeding device refeeds, toward the image forming device again, the sheet switched back by reverse rotation of the switchback device. The reverse path guides the sheet refed by the refeeding device to a non-opposing surface of the conveyance device opposite to the opposing surface, reverses the sheet, and guides the sheet to the opposing surface of the conveyance device again. The single driving source drives the conveyance device and the switchback device. The driving assembly transmits driving force of the driving source to the conveyance device. The clutch assembly is disposed at a position other than the driving assembly to switch rotation of the switchback device between forward rotation and reverse rotation. The activation device activates the clutch assembly to switch rotation of the switchback device between forward rotation and reverse rotation.

In another aspect of this disclosure, there is provided an image forming apparatus including conveying means, image forming means, switchback means, refeeding means, a reverse path, a single driving source, a driving assembly, a clutch assembly, and activating means. The conveying means conveys a sheet of recording media. The image forming means forms an image on the sheet conveyed by the conveying means. The switchback means switches back the sheet at a position downstream from the conveying means after the image forming means forms an image on a first face of the sheet on an opposing surface of the conveying means opposing the image forming means. The switchback means is rotatable in forward and reverse directions. The refeeding means refeeds, toward the image forming means again, the sheet switched back by reverse rotation of the switchback means. The reverse path guides the sheet refed by the refeeding means to a non-opposing surface of the conveying means opposite to the opposing surface, reverses the sheet, and guides the sheet to the opposing surface of the conveying means again. The single driving source drives the conveying means and the switchback means. The driving assembly transmits driving force of the driving source to the conveying means. The clutch assembly is disposed at a position other than the driving assembly to switch rotation of the switchback means between forward rotation and reverse rotation. The activating means activates the clutch assembly to switch rotation of the switchback means between forward rotation and reverse rotation.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
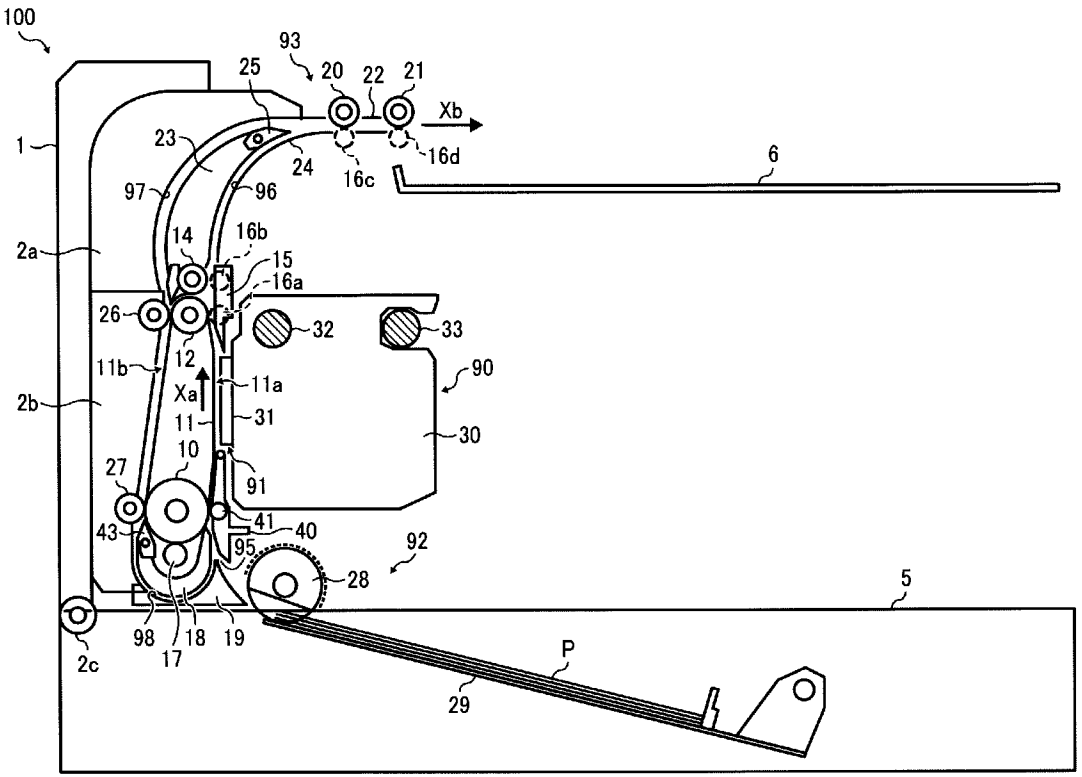
FIG. 1 is a schematic partial cross-sectional front view of a configuration of an inkjet printer shown as an example of an image forming apparatus according to first and second exemplary embodiments of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below. In the following exemplary embodiments, the same reference characters are allocated to elements (members or components) having the same function and shape and redundant descriptions thereof are omitted below. For sake of simplicity and clearness, elements considered to require no specific descriptions may be omitted from drawings.

First Exemplary Embodiment

A first exemplary embodiment of this disclosure is described with reference to FIGS. 1 to 5C.

FIG. 1 is a schematic front view of an inkjet printer according to the first exemplary embodiment of this disclosure.

First, with reference to FIG. 1, the entire configuration and operation of an inkjet recording apparatus (hereinafter, inkjet printer) serving as an example of an image forming apparatus according to the first exemplary embodiment is described. Then, a clutch assembly in the first exemplary embodiment is described.

An inkjet recording apparatus 100 illustrated in FIG. 1 is a serial-type inkjet recording apparatus that forms images according to an inkjet method. The inkjet printer 100 has an image forming section 90, a conveyance section 91, a sheet feed device 92, and an output-and-reversal section 93. The image forming section 90 includes, e.g., a recording head 31 serving as an image forming device to form images according to an inkjet method. The conveyance section 91 includes, e.g., a conveyance belt 11 to convey a sheet P of recording media or recorded media (e.g., sheet of paper), and the sheet feed section 92 feeds the sheet P. The output-and-reversal section 53 has a function of a sheet output device to output the sheet P having an image(s) formed (printed) thereon to the outside and a function of a refeeding device to re-feed the sheet P having an image formed on its single side in a switchback manner to reverse the sheet P.

A sheet feed path of the sheet P includes a sheet feed transport passage 95, a common transport passage 96, a refeeding passage 97, and a bypass passage 98. The sheet feed transport passage 95 serves as a path to transport the sheet P fed from the sheet feed section 92 to the conveyance section 91. The common transport passage 96 is connected to and communicates with (hereinafter, simply referred to as "connected to") the sheet feed transport passage 95, and serves as a path to transport, to an area downstream from the image forming section 90, a single-side printed sheet P having an image formed on its front face (first face) or a duplex printed sheet P having images formed on both faces (i.e., in which an image has been formed on a back face (second face) of the single-sided printed sheet P switched back and refed). The refeeding passage 97 is connected to the common conveyance passage 96, and serves as a refeeding path to guide the single-side printed sheet P switched back and refed by output rollers 20 and 21 serving as the refeeding device, to a surface (hereinafter, non-opposing surface 11*b*) of the conveyance belt 11 at a side opposite a side opposing (facing) the recording head 31 of the image forming section 90. The bypass passage 98 serves as a reverse path to guide the single-side printed sheet P again to a surface (hereinafter "opposing surface 11*a*") of the conveyance belt 11 at the side opposing the recording head 31, after the single-side printed sheet P passes the non-opposing surface 11*b* of the conveyance belt 11 and is reversed while bypassing an outer circumferential part of the conveyance belt 11 wound around a conveyance roller 10. As illustrated in FIG. 1, the conveyance roller 10 is disposed at an area upstream from an area opposing the recording head 31 in a traveling direction of the conveyance belt 11. The refeeding passage 97 and the bypass passage 98 may be collectively referred to as a duplex transport passage serving as a duplex transport path.

The sheet feed transport passage 95 is defined by, e.g., an inner duplex guide 18 serving as an inner guide member of the bypass passage 98, an outer duplex guide 19 serving as an outer guide member, and a portion of a front-end pressing plate 40 also serving as a guide member so as to have a certain amount of clearance. The common transport passage 96 is defined by, e.g., a portion of the front-end pressing plate 40, a lower output guide 24 serving as a guide member, and a middle output guide 23 serving as a guide member so as to have a certain amount of clearance. The refeeding passage 97 is defined by, e.g., the middle output guide 23, an upper duplex guide 2*a* integrally formed with a front cover 1 serving as an opening-and-closing member, and a lower duplex guide 2*b* integrally formed with the front cover 1 so as to have a certain amount of clearance. As illustrated in FIG. 1, a shaft 2*c* is supported on a portion of an apparatus body near a sheet feed tray 5 so as to be rotatable in a certain range of angles (i.e., rotatable clockwise and counterclockwise, which is the same hereinafter). The front cover 1 is pivotable around the shaft 2*c* between a closed position illustrated in FIG. 1 and an open position which the front cover 1 is pivoted counterclockwise from the closed position to take. When the front cover 1 is placed at the open position, the duplex transport passage (the refeeding passage 97 and the bypass passage 98) is opened so that an operator can remove a jammed sheet or replace components from the front side of the printer. The bypass passage 98 is defined by, e.g., the inner duplex guide 18 and the outer duplex guide 19 so as to have a certain amount of clearance. The above-described guide members, such as the common transport passage 96 and the refeeding passage 97, are provided with various transport rollers and spurs, some of which are indicated by broken lines. In FIG. 1, only several of the transport rollers and spurs are illustrated for conciseness of description and drawing.

The image forming section 90 includes a carriage 30 serving as a moving member movable for scanning. The carriage 30 is supported by a main guide rod 32 and a sub guide rod 33 serving as guide members so as to be reciprocally slidable along a main scanning direction (a direction perpendicular to a sheet face on which FIG. 1 is printed, i.e., a direction from a front side to a back side of the sheet face or vice versa). The main guide rod 32 and the sub guide rod 33 are mounted and fixed at the apparatus body to extend across the apparatus body. The carriage 30 is connected to a main scanning motor via a timing belt and reciprocally moved for scanning in the main scanning direction by the main scanning motor.

The carriage 30 mounts the recording head 31 serving as a liquid ejection head to eject ink droplets of different colors, e.g., yellow (Y), cyan (C), magenta (M), and black (K). The recording head 31 is disposed opposing the conveyance belt 11 and serves as an image forming device or recording device to form an image on a sheet P conveyed by the opposing face 11*a* of the conveyance belt 11. The recording head 31 has multiple nozzles arranged in rows in a sub-scanning direction (sheet transport direction) Xa perpendicular to the main scanning direction and are mounted on the carriage 30 so as to substantially horizontally eject ink droplets. The recording head 31 has, for example, four nozzle rows to separately eject ink droplets of black (K), cyan (C), magenta (M), and yellow (Y).

The carriage 30 mounts head tanks to supply the respective color inks to the corresponding nozzle rows of the recording head 31. A supply pump unit supplies (replenishes) the respective colors of recording liquids from recording-liquid cartridges to the head tanks via supply tubes dedicated for the respective colors of recording liquids. The recording-liquid cartridges are removably mountable to a cartridge mount portion.

The sheet feed section 92 includes, e.g., the sheet feed tray 5 having a bottom plate 29 movable up and down with multiple sheets P stacked thereon and a sheet feed roller 28 having, e.g., a substantially half-moon shape to feed the sheets P stacked on the base plate 29, and a separation pad having a high friction coefficient against the sheet P to separate and feed the sheets P sheet by sheet in conjunction with the sheet feed roller 28. The above-described separation pad is urged toward the sheet feed roller 28.

A sheet P fed from the sheet feed section 92 in simplex printing or a single-side printed sheet P having been reversed in duplex printing is sent via the conveyance section 91 to a position at which the image forming section 90 opposes the recording head 31. The conveyance section 91 serving as conveyance device includes, e.g., the conveyance belt 11, the conveyance roller 10, a tension roller 12, a front end pressing roller 41, and a charging roller 17.

The conveyance belt 11 adheres the sheet P thereon by electrostatic force and conveys the sheet P to the position opposing the recording head 31. Thus, the conveyance belt 11 serves as a conveyance unit to intermittently convey the sheet P in the sheet transport direction Xa. The conveyance belt 11 is an endless belt looped around the conveyance roller 10 serving as a rotary driving member and the tension roller 12 serving as a rotary driven member so as to circulate in a belt traveling direction Xa, which is the same as the sheet transport direction (sub-scanning direction) Xa. As indicated by broken lines in FIGS. 4A and 4B, the conveyance roller 10 and the tension roller 12 are supported by the apparatus body via shafts 10*a* and 12*a*, respectively, so as to be rotatable in forward and reverse directions.

Figure 4A:
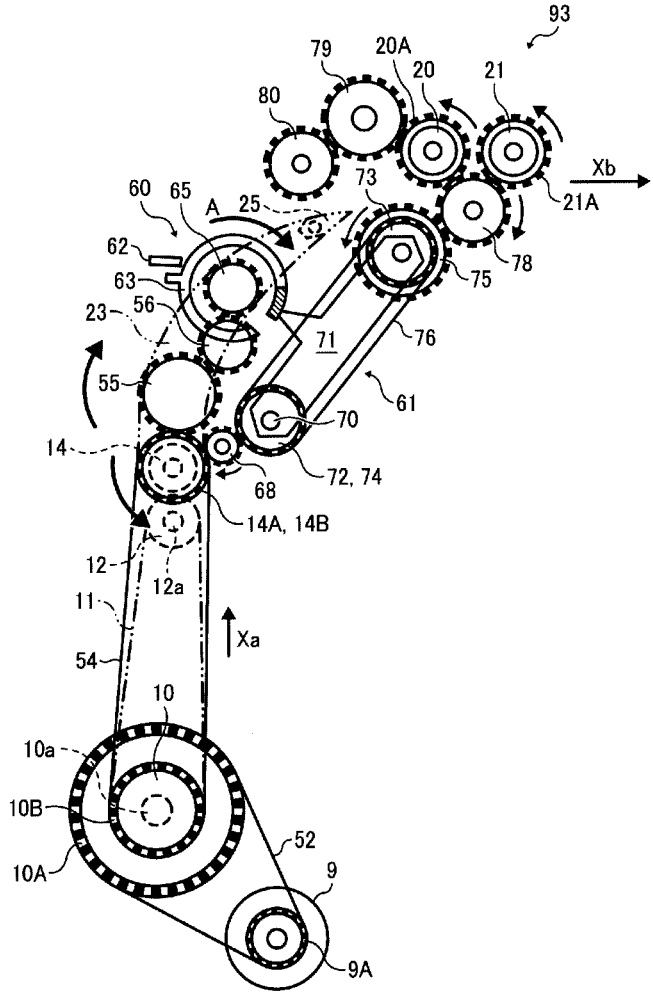
FIGS. 4A and 4B are schematic front views of a driving system, the clutch assembly, and a driving-force transmission assembly from the driving system to an output-and-reversal section in the first exemplary embodiment.
Figure 4B:
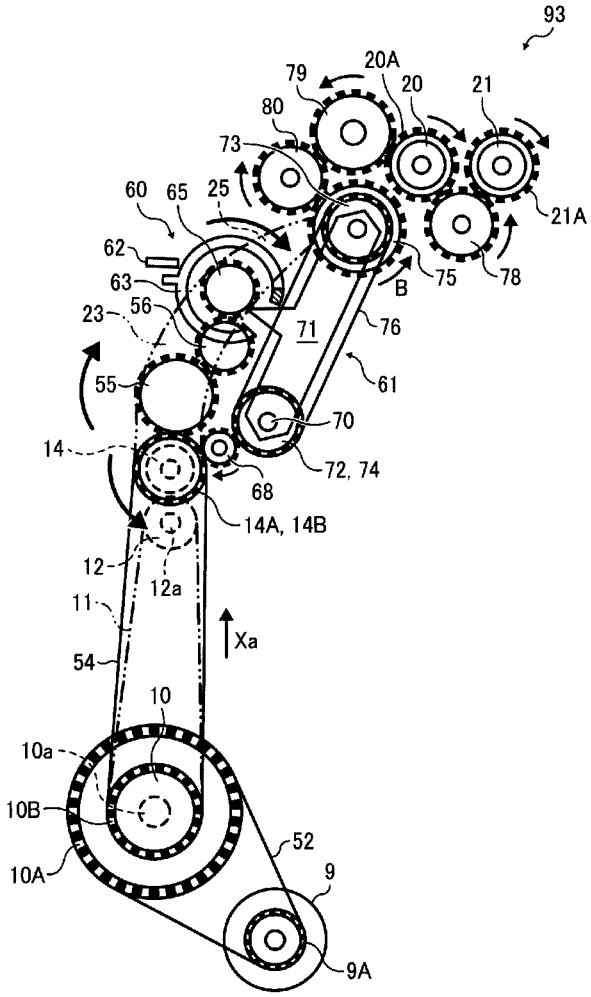

A driving assembly formed with a conveyance motor (sub scanning motor) 9 serving as a single driving source rotates the conveyance roller 10 in the forward and reverse directions via a timing belt 52 serving as a driving force transmission device illustrated in FIGS. 4A and 4B. When the conveyance roller 19 is rotated by the conveyance motor 9 illustrated in FIGS. 4A and 4B, the conveyance belt 11 circulates in the belt traveling direction indicated by the arrow Xa. As described above, in this exemplary embodiment, the conveyance belt 11 is an endless belt. It is to be noted that the conveyance belt may be an endless belt in molding or an endless belt.

The conveyance belt 11 has a single or multi layer structure. At least at a side (outer surface) contacting the sheet P and the charging roller 17, the conveyance belt 11 has an insulation layer of, for example, a resin, such as polyethylene terephthalate (PET), polyether imide (PEI), polyvinylidene fluoride (PVDF), polycarbonate (PC), ethylene tetrafluoroethylene (ETFE), or polytetrafluoroethylene (PTFE), or an elastomer not including conductivity control material to retain electric charges. In a case where a multi layer structure is employed, the conveyance belt 11 may have a conductive layer of the above-mentioned resin or elastomer containing carbon at a side not contacting the charging roller 17.

The front end pressing roller 41 serves as a pressing member to press the conveyance belt 11 from an outer surface side (conveyance face side). The front end pressing roller 41 is disposed adjacent to and upstream from the recording head 31 in the belt traveling direction Xa of the conveyance belt 11 so as to press against the conveyance roller 10 via the conveyance belt 11, thus causing the sheet P to closely contact the conveyance belt 11. The conveyance guide plate is disposed at a position between the conveyance roller 10 and the tension roller 12 and opposing the recording head 31 inside the loop of the conveyance belt 11, and serves as a belt guide member to guide the conveyance belt 11 from the inside of the loop of the conveyance belt 11.

The charging roller 17 is disposed upstream from the conveyance roller 10 in the belt traveling direction Xa, and serves as a charger to charge the surface of the conveyance belt 11. The charging roller 17 is disposed so as to contact the outer surface (insulation layer) of the conveyance belt 11 and rotate with the circulation of the conveyance belt 11.

A voltage application unit alternately applies plus outputs and minus outputs, i.e., positive and negative voltages to the charging roller 17 so that the conveyance belt 11 is charged with an alternating voltage pattern, that is, an alternating band pattern of positively-charged areas and negatively-charged areas in the sub-scanning direction Xa, i.e., the belt circulation direction. When the sheet P is fed onto the conveyance belt 11 alternately charged with positive and negative voltages, the sheet P is attached to the conveyance belt 11 by electrostatic force and conveyed in the sub scanning direction Xa by the circulation of the conveyance belt 11.

By driving the recording head 31 in response to image signals under control of a controller while moving the carriage 30, ink droplets are ejected onto the sheet P, which is stopped below the recording head 31, to form one line of a desired image. Then, the sheet P is conveyed at a certain distance by the conveyance belt 11 to prepare for the next recording of another line of the image. When the controller receives a recording end signal or a signal indicating that the rear end of the sheet P has exited from a printing area 10 serving as the recording area of the recording head 31, the recording head 31 finishes the recording operation.

As the sheet output section to output the sheet P on which an image has been formed by the recording head 31, the image forming apparatus further includes a second conveyance roller 14 and a separation-claw spur unit 15. The separation-claw spur unit 15 is disposed downstream from the recording head 31 in the belt traveling direction Xa so as to press against the tension roller 12 via the conveyance belt 11, and also has a function of a separation member to separate the sheet P from the conveyance belt 11. A unit housing of the separation-claw spur unit 15 supports a spur 16*a* (indicated by a circular broken line) rotatable with the tension roller 12 and a spur 16*b* rotatable with the second conveyance roller 14.

Two pairs of sheet output rollers rotatable in forward and reverse directions having both functions of a sheet output device and a refeeding device are disposed at the downstream side of the common transport passage 96 in an area in which the second conveyance roller 14 is disposed. The two pairs of sheet output rollers has are formed with a first output roller pair and a second output roller pair. The first output roller pair (hereinafter, representatively referred to as "first output roller 20") includes a spur 16*c* and a first output roller 20. The spur 16*c* is indicated by a circular broken line and has a roller shape and a star-shaped cross section. The first output roller 20 is disposed opposing the spur 16*c* to contact the spur 16*c*. The second output roller pair (hereinafter, representatively referred to as "second output roller 21") includes a spur 16*d* and a second output roller 21. The second output roller 21 is disposed opposing the spur 16*d* to contact the spur 16*d*. The first output roller 20 and the second output roller 21 are rotatably supported by an upper sheet output guide 22 via a shaft. The spurs 16*c* and 16*d* are rotatably supported by the lower sheet output guide 24 via a shaft. Downstream from the first output roller 20 and the second output roller 21 in the sheet transport direction, a sheet output tray 6 is disposed to stack the sheet P output by the first output roller 20 and the second output roller 21.

The spurs 16*a* and 16*b* contact a face of the sheet P opposing the recording head 31 at positions downstream from the recording head 31. In a case where the sheet P is, for example, a plain sheet of paper, an overhead projector (OHP) sheet, a card, a postcard, an envelope, or any other thick sheet of paper, the spurs 16*a* and 16*b* simply assist to feed the sheet P and do not necessarily define a clearance between the face of the sheet P and the recording head 31 by sandwiching the sheet P between the second conveyance roller 14 and the spur 16*a* and between the tension roller 12 and the spur 16*b*, i.e., contacting the spurs 16*a* and 16*b* with the sheet P.

Next, a configuration of duplex printing is described below.

The first output roller 20 and the second output roller 21 and the spurs 16*c* and 16*d* are driven by the conveyance motor 9 serving as a single driving source illustrated in FIGS. 4A and 4B so as to be rotatable both clockwise and counterclockwise, in other words, forward and reverse directions, thus allowing switchback operation for switching the front end and the back end of a single-side printed sheet P. In other words, the first and second output rollers 20, 21 and the spurs 16*c* and 16*d* serve as the switchback device to switch back the single-side printed sheet P having passed the opposing surface 11*a* of the conveyance belt 11 and the refeeding device to feed the single-side printed sheet P toward the recording head 31 of the image forming section 90 again.

A branching claw 25 serving as a branching member and a transport path switching device pivotable around a support shaft to switch the sheet P back is disposed at a branching section at which the common conveyance passage 96 of the output-and-reversal section 93 branches from the refeeding passage 97. A registration roller 26 serving as a registration member and a rotary body to contact the non-opposing surface 11*b* of the conveyance belt 11 is disposed opposing the tension roller 12 at an upper portion of the lower duplex guide 2*b*. A duplex conveyance roller 27 serving as a pressing member is rotatably supported at a lower portion of the lower duplex guide 2*b* so as to press the conveyance belt 11 against the conveyance roller 10. A separation claw 43 serving as a separating member is disposed at a position of the inner duplex guide 18 adjacent to an entry of the bypass passage 98 so as to press the conveyance belt 11 against the conveyance roller 10. As described above, the refeeding device includes the first and second output rollers 20, 21, the registration roller 26, the duplex conveyance roller 27, the refeeding passage 97, the non-opposing surface 11*b* of the conveyance belt 11, and the branching claw 25.

Next, operation of the inkjet printer 100 according to the first exemplary embodiment is described below with reference to FIGS. 1 to 3B.

First, simplex printing (printing on, e.g., a first face of a sheet P) is described below.

When a power switch is turned on and an operator finishes inputs, such as the number of prints and scaling, with keys/buttons of an operation unit, the sheet feed section 92 illustrated in FIG. 1 receives control commands from a controller for controlling operations of the inkjet printer 100 and turns into an activation ready state in synchronization with the image forming section 90 and the conveyance section 91. In other words, the sheet feed roller 28 and the separation pad cooperate to separate and feed the sheets P on the bottom plate 29 of the sheet feed tray 5 sheet by sheet. Furthermore, the sheet P is sent to a nipping portion between the front end pressing roller 41 and the conveyance belt 11 through the sheet feed transport passage 95.

At this time, the conveyance roller 10 is rotated by the conveyance motor 9 illustrated in FIGS. 4A and 4B, so that the conveyance belt 11 circulates in the sub-scanning direction (belt traveling direction) Xa. In addition, at this time, the charging roller 17 contacts the outer surface of the conveyance belt 11 and rotates with the circulation of the conveyance belt 11. Meanwhile, the voltage application unit applies alternating voltages to the charging roller 17, thus causing the charging roller 17 to be charged in an alternative band pattern in which positively and negatively charged areas are alternately repeated at a certain width. When the sheet P is fed onto the conveyance belt 11 alternately charged with positive and negative voltages, the sheet P is attached to the conveyance belt 11 by electrostatic force and conveyed in the sub scanning direction Xa by the circulation of the conveyance belt 11. Then, the sheet P is temporarily stopped at a printing position of the recording head 31.

The carriage 30 is driven to move in the main scanning direction (between the front side and the back side in a direction perpendicular to a sheet face on which FIG. 1 is printed), and the recording head 31 is driven in response to image signals. Thus, ink droplets are ejected onto a first face of the sheet P stopped to form one line of a desired image. After the sheet P is conveyed with the conveyance belt 11 at a certain distance, another line of the image is formed.

Then, the sheet P is conveyed by the conveyance belt 11 with the forward rotation of the conveyance roller 10. The sheet P having the image formed on the first face (also referred to as "single-side printed sheet P" or simply "sheet P") is separated from the conveyance belt 11 by the separation-claw spur unit 15, and sent by the second conveyance roller 14 to the output-and-reversal section 93 downstream in the sheet conveyance direction Xa.

With forward rotation of the first and second output rollers 20 and 21, the single-side printed sheet P is further transported from the output-and-reversal section 93 to the downstream side in a sheet output direction Xb while being guided by the upper and lower output guides 22 and 24. When the controller receives a recording end signal or a signal indicating that the rear end of the single-side printed sheet P has exited from the printing area serving as the recording area, the recording operation ends and the sheet P is output and stacked on the sheet output tray 6.

Next, duplex printing operation is described below with reference to FIGS. 1 to 3B.

FIGS. 2A, 2B, 3A and 3B show action and operation including a drive switching timing of a clutch assembly according to the first exemplary embodiment. For ease of understanding, detailed action and operation of the clutch assembly are omitted below where possible.

In FIGS. 2A, 2B, 3A and 3B, the sheet P is indicated by a bold broken line.

Figure 2B:
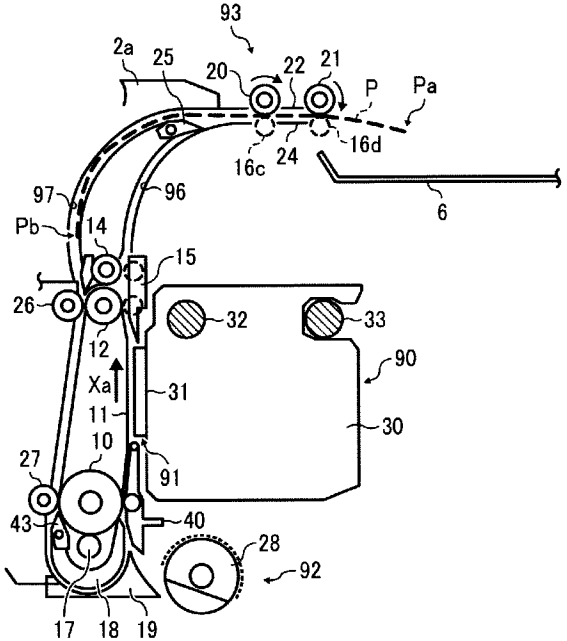
FIGS. 2A and 2B are schematic partial cross-sectional front views of the inkjet printer of FIG. 1 including a clutch assembly.

After simplex printing is performed in the above-described manner, when a front end Pa of the single-side printed sheet P is guided to sandwiching portions (hereinafter, nipping portions) of the first and second output rollers 20 and 21 and a rear end Pb of the single-side printed sheet P passes the branching section (the area at which the branching claw 25 is disposed) of the output-and-reversal section 93 (see FIG. 2A). When the single-side printed sheet P is placed at a switchback position, a sensor detects that the rear end Pb of the single-side printed sheet P has passed the branching section. As a result, the transport of the single-side printed sheet P is temporarily stopped. Meanwhile, the clutch assembly in this first exemplary embodiment switches the action and operation of the first and second output rollers 20 and 21 from forward rotation to reverse rotation. Then, as illustrated in FIG. 2B, the first and second output rollers 20 and 21 and the spurs 16*c* and 16*d* start to rotate in reverse. Thus, switchback operation is performed to switch the front end Pa and the back end Pb of the single-side printed sheet P. Simultaneously with the start of switchback operation, the conveyance belt 11 starts to circulate in the belt traveling direction Xa by the forward rotation of the conveyance roller 10.

Figure 2A:
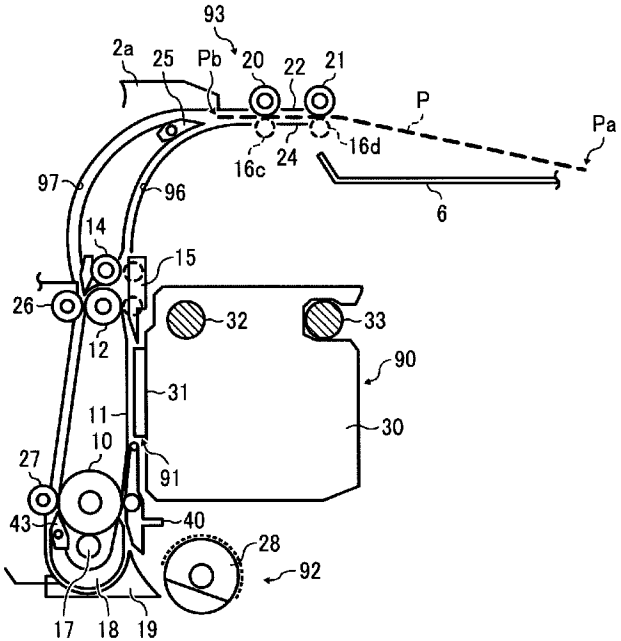

At this time, the branching claw 25 placed at the position illustrated in FIGS. 1 and 2A is pivoted clockwise to switch the transport path of the single-side printed sheet P to the duplex transport passage (the refeeding passage 97).

Next, when a switchback sensor detects a front end Pb of the single-side printed sheet P (which is the rear end Pb of the single-side printed sheet P before switchback but rephrased as "front end Pb" of the sheet P after switchback), the front end Pb of the single-side printed sheet P is transported to the duplex transport passage (the refeeding passage 97) by the first and second output rollers 20 and 21 and the spurs 16*c* and 16*d* while being guided to the duplex transport passage (the refeeding passage 97) by the branching claw 25 (see FIG. 2B).

Figure 3B:
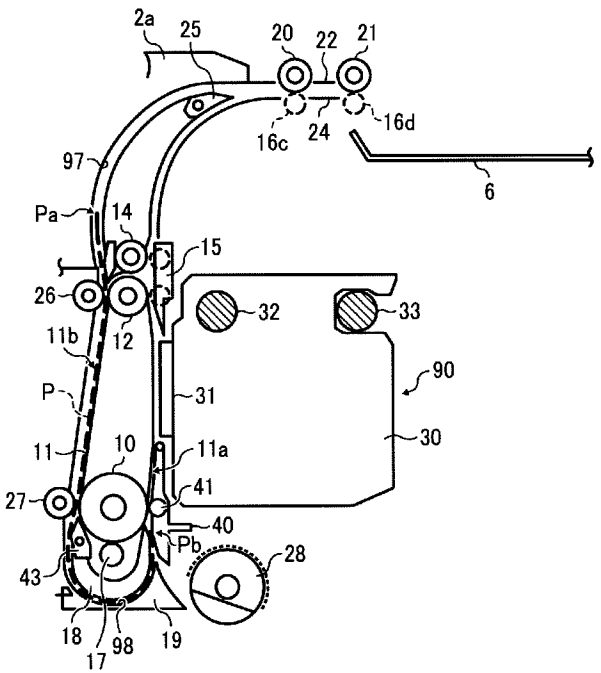
FIGS. 3A and 3B are schematic partial cross-sectional front views of the inkjet printer of FIG. 1 including the clutch assembly.
Figure 3A:
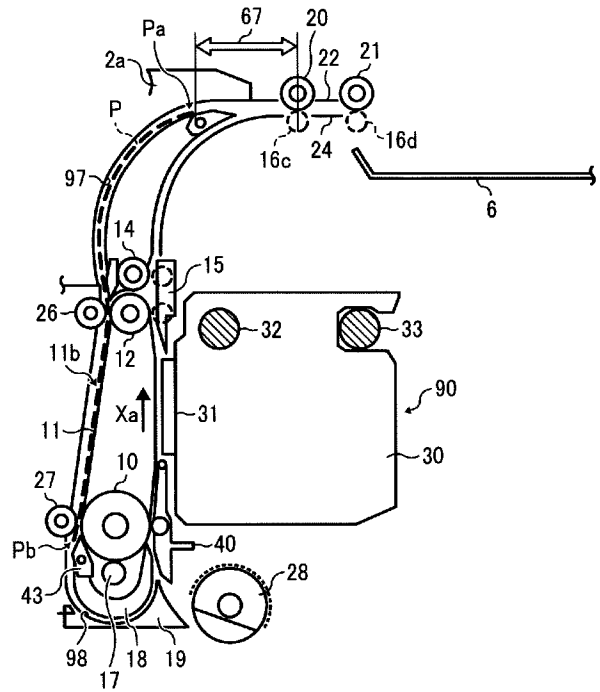

After the switchback, the sheet P is conveyed via the refeeding passage 97 with the sheet P attached on the non-opposing surface 11*b* of the conveyance belt 11 not opposing the recording head 31 as illustrated in FIG. 3A. Then, while being pressed via the conveyance belt 11 by the conveyance roller 10, the single-side printed sheet P switched back is conveyed by the duplex conveyance roller 27 and separated from the conveyance belt 11 by the separation claw 43. As illustrated in FIG. 3B, the sheet P separated from the conveyance belt 11 is guided along the reverse passage 98, passes the nipping portion between the front end pressing roller 41 and the conveyance roller 10, and is conveyed again to the area opposing the recording head 31 with circulation of the conveyance belt 11. At this time, in the same manner as the above-described manner, the single-side printed sheet P is attached to the opposing surface 11*a* of the conveyance belt 11 and conveyed to the printing area of the recording head 31. The charging roller 17 is disposed at an inner side of the reverse passage 98, thus allowing the sheet P switched back to be consistently attached to a freshly charged state of the conveyance belt 11.

Here, descriptions of subsequent operations are omitted for simplicity, because one of ordinal skill in the art would be able to understand and execute the subsequent operations based on the above description of simplex printing.

According to this first exemplary embodiment, in the inkjet printer 100 serving as an image forming apparatus capable of performing duplex printing (double-face printing), the refeeding device (the first and second output rollers 20 and 21, the registration roller 26, the duplex conveyance roller 27, the refeeding passage 97, the branching claw 25, and so forth) is arranged to refeed and guide the single-side printed sheet P to the non-opposing surface 11*b* of the conveyance belt 11 not opposing the recording head 31. Such a configuration can minimize the size and cost of the image forming apparatus.

As described above, the inkjet printer 100 according to the first exemplary embodiment has the front cover 1 and so on, thus allowing an operator to perform front operation (removing of jammed sheets and replacement of components from the front face of the apparatus) while minimizing the size of the apparatus body (machine body).

To minimize the machine size and the number of components while allowing front operation, the inkjet printer 100 according to the first exemplary embodiment has the sheet transport path to form an image on a sheet by substantially horizontally ejecting ink droplets while moving the carriage 30 mounting the recording head 31 in the main scanning direction. Such a configuration allows an operator to access to the sheet feed tray 5 from the front face of the apparatus corresponding to the left side of FIG. 1, and the sheet P to be output with a printed face side facing down (face-down sheet output), thus reducing the machine size as compared with a conventional S-shaped transport path to form an image by ejecting ink downward.

In addition, likewise, to allow an operator to deal with a sheet jam from the front side of the apparatus body while minimizing the machine size and the number of components, the duplex transport passage to reverse a single-side printed sheet to form an image on its second (back) face has a configuration in which the sheet P separated from the conveyance belt 11 is once switched back at the sheet output section or the output-and-reversal section and conveyed with the sheet P attached to the non-opposing surface 11*b* of the conveyance belt 11 not opposing the carriage 30 again.

Next, the driving assembly, the clutch assembly, and the driving-force transmission assembly from the driving assembly to the output-and-reversal section 93, a conveyance assembly in this first exemplary embodiment are described with reference to FIGS. 4A, 4B, 5A, 5B, and 5C.

Figure 5A:
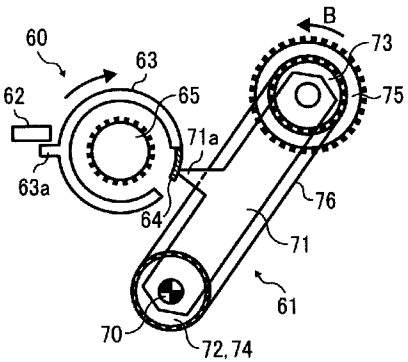
FIGS. 5A to 5C are schematic partially front views of the clutch assembly in the first exemplary embodiment.
Figure 5B:
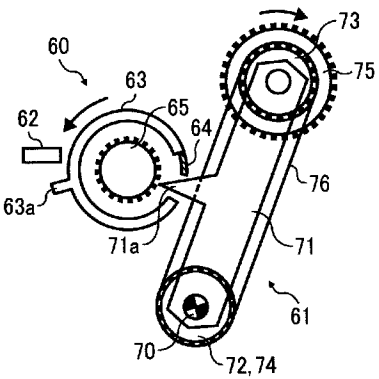
Figure 5C:
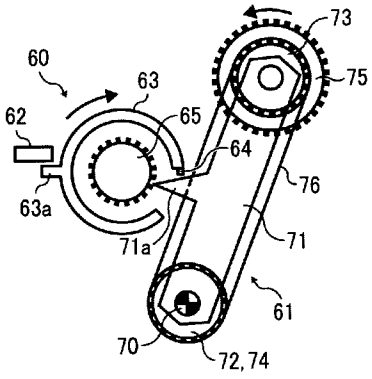

FIGS. 4A and 4B show a configuration and operation of each of the driving assembly, the clutch assembly, and the driving-force transmission assembly from the driving assembly to the output-and-reversal section 93, and the conveyance assembly in this first exemplary embodiment. FIGS. 5A to 5C are enlarged views illustrating a configuration and operation of the clutch assembly according to this exemplary embodiment. Hereinafter, the term "FIG. 4" is used to refer to a common configuration of both assemblies illustrated in FIGS. 4A and 4B, and the term "FIG. 5" is used to refer to a common configuration of both assemblies illustrated in FIGS. 5A to 5C. In FIG. 4, except for the first and second output rollers 20 and 21 illustrated in FIG. 1, for example, the conveyance roller 10, the conveyance belt 11, the tension roller 12, the second conveyance roller 14, the middle output guide 23, and the branching claw 25 are indicated by broken lines for clarity.

As illustrated in FIG. 4, the driving assembly according to the first exemplary embodiment has at least the conveyance motor 9 and the timing belt 52. The conveyance motor 9 serves as a single driving source or driving device to drive the conveyance belt 11 serving as conveyance unit and the first and second output rollers 20 and 21 serving as switchback device. The timing belt 52 is looped between a motor pulley 9A having teeth and fixed on an output shaft of the conveyance motor 9 and a conveyance-roller driving pulley 10A having teeth and fixed at one end of the shaft 10*a* (e.g., the rear side of a sheet face on which FIG. 4 is printed) coaxially with the conveyance roller 10.

The conveyance motor 9 is a direct-current (DC) motor rotatable in forward and reverse directions. A rotary encoder with a large number of slits is fixed on an end portion of the shaft 10*a* of the conveyance roller 10. An encoder sensor formed with a transmissive photosensor to detect the rotational driving amount or the number of rotation per unit time of the conveyance motor 9 is fixed at a portion of the apparatus body near the rotary encoder. The encoder sensor and the rotary encoder form a pulse encoder. The pulse encoder detects whether the rotational driving amount of the conveyance motor 9 is accurately transmitted to the conveyance roller 10 near the image forming section 90 via the timing belt 52 controlled so as to have a proper tension. In this exemplary embodiment, the timing belt 52 is used as a driving force transmission device. Alternatively, the driving force transmission device may be gears, or the conveyance motor 9 may be directly connected to the shaft 10*a* of the conveyance roller 10 if mechanically acceptable.

In an upper area than the carriage 30, an encoder scale with slits and an encoder sensor formed with a transmissive photosensor to detect the slits of the encoder scale are provided to form an encoder to detect the position of the carriage 30 in the main scanning direction.

A conveyance-roller pulley 10B with teeth is fixed at one end portion of the shaft 10*a* of the conveyance roller 10 (e.g., the rear side of a sheet face on which FIG. 4 is printed). A second conveyance-roller pulley 14A with teeth is fixed at one end portion (e.g., the rear side of a sheet face on which FIG. 4 is printed) of a shaft 14*a* of the second conveyance roller 14. A timing belt 54 is looped between the conveyance-roller pulley 10B and the second conveyance-roller pulley 14A. Thus, the tension roller 12 and the second conveyance roller 14 are rotated in the same direction by the conveyance motor 9 serving as a single and identical driving source via the conveyance belt 11 and the timing belt 54 serving as driving force transmission device.

At an end portion of the shaft 14*a* of the second conveyance roller 14 is fixed a second conveyance-roller gear 14B having substantially the same diameter as the second conveyance-roller pulley 14A. (Since the second conveyance-roller pulley 14A is located at a rear side of the second conveyance-roller pulley 14A, the second conveyance-roller pulley 14A cannot be seen from the front face in FIGS. 4A and 4B).

At a portion of the apparatus body near the second conveyance roller 14, a first intermediate gear 55 constantly engaging the second conveyance-roller gear 14B and a second intermediate gear 56 constantly engaging the first intermediate gear 55 are rotatably supported via gear shafts. The second intermediate gear 56 constantly engages a clutch control gear 65 forming part of a clutch control device 60. At a portion of the apparatus body at an obliquely upper right position relative to and adjacent to the second conveyance roller 14, an intermediate gear 68 constantly engaging both the second conveyance-roller gear 14B and a first clutch gear 74 of a clutch pivoting device 61 is rotatably supported via a gear shaft.

The clutch assembly according to the first exemplary embodiment (hereinafter, also simply referred to as "clutch assembly" in the following description of the first exemplary embodiment) has the clutch control device 60 and the clutch pivoting device 61, which is also referred to as a double clutch mechanism. The clutch assembly according to the first exemplary embodiment has a function and configuration to activate the clutch assembly in response to a certain amount of reverse rotation of the conveyance belt 11 or the conveyance roller 10 serving as conveyance device to change the rotation direction of the first and second output rollers 20 and 21. Here, a certain amount of reverse rotation of the conveyance belt 11 or the conveyance roller 10 serves as activation means to activate the clutch assembly in the first exemplary embodiment.

When the single-side printed sheet P or the single-side printed sheet P switched back is transported along the reverse path by the refeeding device as described above, operations available to enhance printing productivity are the forward rotation of the conveyance roller 10 driven by the forward-rotation driving of the conveyance motor 9 and the forward rotation of the conveyance belt 11 in the belt travelling direction (sheet transport direction) Xa. Hence, the clutch assembly according to the first exemplary embodiment effectively utilizes a certain amount of reverse rotation (e.g., several millimeters or less when the amount is converted to a sheet conveyance distance) at a time except for the forward rotation of the conveyance roller 10 and the conveyance belt 11, as activator or trigger means to switch or change the rotation direction of the first and second output rollers 20 and 21.

As illustrated in FIG. 5, the clutch control device 60 is rotatably supported by a support unit disposed at the apparatus body and has a first rotary body 63 with a projecting portion 63*a*, a stopper 62 fixed at a predetermined position of the apparatus body, a second rotary body 64 rotatably supported in the first rotary body 63, and the clutch control gear 65 integrally provided with the first rotary body 63 and constantly engaging the second intermediate gear 56. The first rotary body 63 has a partially cut-out ring shape in which a minor arc portion is cut out from a ring when seen from a front face side in FIG. 5. The second rotary body 64 is indicated by hatching in FIGS. 4 and 5, and is urged by a spring so as to be able to project to a position on an extended circle of the cutout portion of the first rotary body 63 illustrated in FIG. 5A. Thus, the second rotary body 64 is disposed so as to be able to emerge and retract relative to the cutout portion of the first rotary body 63. The clutch control gear 65 has a relatively large tooth width to project beyond, e.g., the first rotary body 63 toward the front side of a sheet face on which FIG. 5 is printed so that the clutch control gear 65 can constantly engage the second intermediate gear 56 and selectively engage a projecting portion 71*a* of a pivoting arm 71.

During forward rotation of the conveyance roller 10 and the conveyance belt 11, in other words, when each of the conveyance roller 10 and the conveyance belt 11 circulates in the sub-scanning direction (belt travelling direction) Xa as illustrated in FIG. 4A, a counterclockwise driving force (right-handed rotation torque) indicated by an arrow A in FIG. 4A is transmitted to the first rotary body 63 of the clutch control device 60 via the driving force transmission device including the travelling or rotation of the timing belt 54, the second conveyance-roller pulley 14A, the second conveyance-roller gear 14B, the first intermediate gear 55, the second intermediate gear 56, and the clutch control gear 65. When a load equal to or greater than a threshold is applied, the projecting portion 63*a* contacts the stopper 62 to stop the rotation of the first rotary body 63 at a certain position.

During reverse rotation of the conveyance roller 10 and the conveyance belt 11, by contrast, a counterclockwise driving force (left-handed rotation torque) is transmitted via the driving force transmission device. When a load (torque) equal to or greater than a threshold is applied, the rotation of the first rotary body 63 stops. In other words, a torque is applied in a direction in connection with and in conjunction with the rotation of the conveyance roller 10 and the conveyance belt 11. When a load (torque) equal to or greater than a threshold is applied, the rotation of the first rotary body 63 stops. Such a configuration is typically achieved by a friction force created by, e.g., a spring. A range of the minor-arc cutout portion of the first rotary body 63 is set to adjust a certain amount of reverse rotation of the conveyance roller 10 and the conveyance belt 11 driven by the conveyance motor 9. The second rotary body 64 is also provided to adjust the certain amount of reverse rotation of the conveyance roller 10 and the conveyance belt 11.

As illustrated in FIG. 5, the clutch pivoting device 61 includes a support shaft 70, the pivoting arm 71, a first clutch pulley 72, a second clutch pulley 73, a timing belt 76, the first clutch gear 74, and a second clutch gear 75. The support shaft 70 is pivotably supported at the apparatus body. The pivoting arm 71 is fixed on the support shaft 70 at one end so as to be pivotable around the support shaft 70. The first clutch pulley 72 with teeth is rotatably supported on the support shaft 70. The second clutch pulley 73 with teeth is rotatably disposed at the opposite end of the pivoting arm 71 via a shaft. The timing belt 76 is looped between the first clutch pulley 72 and the second clutch pulley 73. The first clutch gear 74 is provided coaxially and rotatably with the first clutch pulley 72 and constantly engages the second conveyance-roller gear 14B. The second clutch gear 75 is provided coaxially and rotatably with the second clutch pulley 73 and selectively engages an output-roller intermediate gear 78 or a first output-roller driving transmission gear 80. At a side wall portion of the pivoting arm 71 opposing the cutout portion of the first rotary body 63, the projecting portion 71*a* of, e.g., a triangle shape is formed so as to project toward the cutout portion.

As illustrated in FIG. 4, a first output roller gear 20A is coaxially fixed with the first output roller 20 so that the first output roller gear 20A rotates with the first output roller 20 in the same direction. A second output roller gear 21A is coaxially fixed with the second output roller 21. Between the first output roller gear 20A and the second output roller gear 21A, the output-roller intermediate gear 78 constantly engaging both the first output roller gear 20A and the second output roller gear 21A is rotatably supported by the apparatus body via the shaft. In other words, the first output roller gear 20A has a gear train structure to rotate with the second output roller gear 21A in the same direction via the engagement with the output-roller intermediate gear 78. Thus, the first output roller 20 always rotates in the same direction as a direction in which the second output roller 21 rotates.

At a position near the first output roller 20, a first output-roller intermediate gear 79 constantly engaging the first output roller gear 20A is rotatably supported by the apparatus body via a shaft. At a portion of the apparatus body at an obliquely lower left position relative to and adjacent to the first output-roller intermediate gear 79, the first output-roller driving transmission gear 80 constantly engaging the first output-roller intermediate gear 79 and selectively engaging the second clutch gear 75 is rotatably supported by the apparatus body via a shaft.

The clutch pivoting device 61 has a similar mechanism to the clutch control device 60. During forward rotation of the conveyance roller 10, a counterclockwise driving force (left-handed torque) acts on the clutch pivoting device 61 via the driving force transmission device including, e.g., the timing belt 54, the second conveyance-roller pulley 14A, the second conveyance-roller gear 14B, the first clutch gear 74, the first clutch pulley 72, the timing belt 76, the second clutch pulley 73, and the second clutch gear 75. Thus, the clutch pivoting device 61 pivots in connection with and in conjunction with the rotation of the conveyance roller 10 and the conveyance belt 11. When a load equal to or greater than a threshold is applied, the pivoting of the clutch pivoting device 61 stops.

As illustrated in FIGS. 4A and 5A, in the forward rotation of the conveyance roller 10, the clutch pivoting device 61 pivots counterclockwise (rotates in left direction) around the support shaft 70. As illustrated in FIGS. 4B and 5B, in the reverse rotation of the conveyance roller 10, the clutch pivoting device 61 pivots clockwise (rotates in right direction) around the support shaft 70.

FIG. 5A shows a state of a clutch position in the forward rotation of the conveyance roller 10.

At this state, in the configuration of the driving force transmission device of the clutch control device 60 illustrated in FIG. 4A, the first rotary body 63 rotates clockwise. However, by a contact of the projecting portion 63*a* of the first rotary body 63 with the stopper 62, the rotation of the first rotary body 63 is stopped at a certain position. At this time, the second rotary body 64 is projected by an urging force of the spring so as to block substantially half of the cutout portion of the first rotary body 63. Meanwhile, the clutch pivoting device 61 receives torque acting in a direction to pivot counterclockwise around the support shaft 70. However, the projecting portion 71*a* of the pivoting arm 71 interferes with the second rotary body 64 projecting to block substantially half of the cutout portion of the first rotary body 63, thus preventing the clutch pivoting device 61 from further pivoting counterclockwise.

In a positional state of the clutch pivoting device 61 illustrated in FIG. 5A during forward rotation of the conveyance roller 10, as illustrated in FIG. 4A, the second clutch gear 75 rotates counterclockwise, as indicated by an arrow B, via the driving force transmission device including the timing belt 54, the second conveyance-roller pulley 14A, the second conveyance-roller gear 14B, the intermediate gear 68, the first clutch gear 74, the first clutch pulley 72, the timing belt 76, the second clutch pulley 73, and the second clutch gear 75. Thus, the second clutch gear 75 engages the output-roller intermediate gear 78. As a result, the output-roller intermediate gear 78 rotates clockwise, and the single-side printed sheet P is transported in the sheet output direction indicated by the arrow Xb in FIG. 4A by the counterclockwise (forward) rotation transport of the first and second output rollers 20 and 21.

When the conveyance roller 10 rotates in reverse at a certain amount from the state of FIG. 5A, as illustrated in FIG. 5B, the first rotary body 63 rotates counterclockwise at a certain amount and the clutch pivoting device 61 pivots clockwise around the support shaft 70. As a result, the projecting portion 71*a* of the pivoting arm 71 is inserted between the cutout portion of the first rotary body 63 and the second rotary body 64 blocking substantially half of the cutout portion. Thus, the first rotary body 63 of the clutch control device 60 and the clutch pivoting device 61 take a positional state illustrated in FIG. 5B.

Then, when the conveyance roller 10 rotates forward again, as illustrated in FIG. 5C, the first rotary body 63 rotates clockwise and the projecting portion 63*a* of the first rotary body 63 contacts the stopper 62. As a result, the rotation of the first rotary body 63 is stopped and the projecting portion 71*a* of the pivoting arm 71 is inserted between adjacent teeth of the clutch control gear 65. Thus, the clockwise pivoting of the pivoting arm 71 is stopped at a certain position illustrated in FIG. 5B. At this time, the projecting portion 71*a* of the pivoting arm 71 contacts the front end of the second rotary body 64, and the second rotary body 64 is pushed into the first rotary body 63 against the urging force of the spring. As a result, an amount at which the projecting portion 71*a* of the pivoting arm 71 projects in the cutout portion of the first rotary body 63 decreases. Thus, the first rotary body 63 and the clutch pivoting device 61 take a positional state illustrated in FIG. 5C. The positional state illustrated in FIG. 5C corresponds to a positional state illustrated in FIG. 4B. In the positional state, the rotation direction of each of the first and second output rollers 20 and 21 is changed to the reverse direction to switch back the sheet.

In other words, in the positional state of the clutch pivoting device 61 illustrated in FIG. 5C, as illustrated in FIG. 4B, the second clutch gear 75 rotates counterclockwise, as indicated by the arrow B, via the driving force transmission device including the timing belt 54, the second conveyance-roller pulley 14A, the second conveyance-roller gear 14B, the intermediate gear 68, the first clutch gear 74, the first clutch pulley 72, the timing belt 76, the second clutch pulley 73, and the second clutch gear 75. Thus, the second clutch gear 75 engages the first output-roller driving transmission gear 80. As a result, the first output-roller driving transmission gear 80 rotates clockwise. Through counterclockwise rotation of the first output-roller intermediate gear 79 and clockwise rotation of the first output roller gear 20A, the first and second output rollers 20 and 21 rotate clockwise (in reverse) to switch back the single-side printed sheet P.

When the conveyance roller 10 rotates in reverse again at a certain amount from the state of FIG. 5C in which the first and second output rollers 20 and 21 rotate in reverse and the conveyance roller 10 rotates forward, the spring urging the second rotary body 64 reacts and, in a moment, the second rotary body 64 returns to the state illustrated in FIG. 5A, thus preventing the clutch pivoting device 61 from further pivoting counterclockwise. As a result, as illustrated in FIG. 4A, the rotation direction of each of the first and second output rollers 20 and 21 is switched to the forward rotation again. In other words, the first output roller gear 20A rotates counterclockwise, and the first and second output rollers 20 and 21 returns to the counterclockwise rotation (forward rotation) transport.

As described above, the clutch assembly according to the first exemplary embodiment does not perform on-off operation of the clutch assembly in response to electric signals received from a position sensor to detect the position of a sheet basically but uses a mechanical mechanism to perform the on-off operation of the clutch assembly. Hence, as described below, a first amount of reverse rotation of the conveyance roller 10 for activating the clutch assembly to switch the rotation of the first and second output rollers 20 and 21 from forward rotation to reverse rotation is set to be different from a second amount of reverse rotation of the conveyance roller 10 for activating the clutch assembly to switch the rotation of the first and second output rollers 20 and 21 from reverse rotation to forward rotation. As a result, in duplex printing, the on-off operation of the clutch assembly is invariably performed at the same timing, thus preventing mechanical hysteresis.

During reverse rotation of the conveyance roller 10, the clutch pivoting device 61 is pivoting for drive switching. Hence, the clutch assembly is configured so as not to transmit the driving of the conveyance motor 9 to the first and second output rollers 20 and 21 during reverse rotation of the conveyance roller 10.

Next, operation of the clutch assembly according to the first exemplary embodiment mainly in duplex printing is described with reference to FIGS. 2A to 5C.

Although not specifically described in the above-described entire operation, to enhance printing productivity in simplex or duplex printing, a conveyance seed of the conveyance belt 11 during non-image forming operation in which the recording head 31 does not perform image formation on a sheet P is set to be faster than a conveyance seed of the conveyance belt 11 during image forming operation in which the recording head 31 performs image formation on a sheet P. In other words, the rotation speed of the conveyance motor 9 is controlled so that the conveyance seed of the conveyance belt 11 during non-image forming operation becomes faster than the conveyance seed of the conveyance belt 11 during image forming operation, which is the same as in a second exemplary embodiment described below.

After simplex printing is performed in the above-described manner, a front end Pa of the single-side printed sheet P is guided to the respective nipping portions of the first and second output rollers 20 and 21 and a rear end Pb of the single-side printed sheet P passes the branching section (the area at which the branching claw 25 is disposed) of the output-and-reversal section 93 (see FIG. 2A). When the single-side printed sheet P is placed at a switchback position, a sensor detects that the rear end Pb of the single-side printed sheet P has passed the branching section. As a result, the transport of the single-side printed sheet P is temporarily stopped. Meanwhile, the clutch assembly in this first exemplary embodiment switches the operation and driving of the first and second output rollers 20 and 21 from forward rotation to reverse rotation. In other words, as illustrated in FIGS. 5A to 5C, the rotation direction of the first and second output rollers 20 and 21 is switched from forward rotation to reverse rotation by a certain amount of reverse rotation of the conveyance roller 10 via the conveyance motor 9 (see FIG. 4B).

As illustrated in FIG. 2A, the certain amount of reverse rotation of the conveyance roller 10 for activating the clutch assembly to switch the rotation of the first and second output rollers 20 and 21 from forward rotation to reverse rotation is set to be not greater than an amount at which the sheet is transported from a position at which the rear end Pb of the single-side printed sheet P passes the branching claw 25 to a position at which the front end Pb first contacts the registration roller 26 (see FIG. 2B). In this regard, if the reverse rotation amount of the conveyance roller 10 with the conveyance motor 9 is set to be longer than a sheet transport distance from the switchback position of the rear end Pb of the single-side printed sheet P illustrated in FIG. 2A to the registration roller 26 rotating in a constant direction, i.e., clockwise direction in the duplex transport passage (refeeding passage 97) (see FIG. 2B), the rotation direction of the registration roller 26 is opposite to the sheet transport direction of the single-side printed sheet P, thus causing a sheet jam. In addition, the front end Pb of the switched-back sheet P once pressed against the non-opposing surface 11*b* of the conveyance belt 11 by the registration roller 26 and charged is undesirably pushed back slightly toward the upstream side of the duplex transport passage (the refeeding passage 97). In fact, the reverse rotation amount of the conveyance roller 10 with the conveyance motor 9 is preferably set to a transport amount (transport distance) at which the front end Pb of the single-side printed sheet P switched back from the switchback position illustrated in FIG. 2A certainly passes over the branching claw 25.

Next, the certain amount of reverse rotation of the conveyance roller 10 for activating the clutch assembly to switch the rotation of the first and second output rollers 20 and 21 from reverse rotation to forward rotation is described with reference to FIGS. 3A and 3B.

Switching the rotation direction of the first and second output rollers 20 and 21 from reverse rotation to forward rotation need be performed after the rear end Pa of the single-side printed sheet P switched back enters the duplex transport passage (refeeding passage 97) and the rear end Pa of the sheet P passes the switchback device, i.e., the first output roller 20. Before the rear end Pa of the sheet P passes the first output roller 20, a rear end portion of the sheet P is sandwiched at the nipping portion between the first output roller 20 and the spur 16*c*. In such a state, if the rotation direction of the first and second output rollers 20 and 21 is switched from reverse rotation to forward rotation, the sheet P is undesirably pushed back toward the upstream side of the duplex transport passage (refeeding passage 97) from a state in which the sheet P is conveyed in the belt traveling direction Xa with a front end side of the sheet P attached on the conveyance belt 11 by static electricity.

For the above-described reason, as illustrated in FIG. 3A, the certain amount of reverse rotation of the conveyance roller 10 for activating the clutch assembly to switch the rotation of the first and second output rollers 20 and 21 from reverse rotation to forward rotation is set to be not greater than a sheet transport amount indicated by an arrow 67 in FIG. 3A in which, after passing the nipping portion between the first output roller 20 and the spur 16*c*, the rear edge Pa of the single-side printed sheet P switched back is transported until the rear edge Pa passes the branching claw 25. The timing of switching the rotation direction of the first and second output rollers 20 and 21 from reverse rotation to forward rotation and the certain amount of reverse rotation of the conveyance roller 10 need be set so as to meet the relationship between the position of the rear edge Pa of the single-side printed sheet P and the sheet transport amount 67. At this time, as illustrated in FIG. 4B, the rotation direction of the first and second output rollers 20 and 21 is switched from reverse rotation to forward rotation by the operation of the clutch assembly.

As described with reference to FIG. 2A, FIG. 2B, and FIG. 3A, the certain amount of reverse rotation of the conveyance roller 10 for activating the clutch assembly to switch the rotation of the first and second output rollers 20 and 21 from forward rotation to reverse rotation is different from the certain amount of reverse rotation of the conveyance roller 10 for activating the clutch assembly to switch the rotation of the first and second output rollers 20 and 21 from reverse rotation to forward rotation. In the first exemplary embodiment, the certain amount of reverse rotation of the conveyance roller 10 for activating the clutch assembly to switch the rotation of the first and second output rollers 20 and 21 from forward rotation to reverse rotation is set to be greater than the certain amount of reverse rotation of the conveyance roller 10 for activating the clutch assembly to switch the rotation of the first and second output rollers 20 and 21 from reverse rotation to forward rotation.

In addition, in the first exemplary embodiment, as illustrated in FIG. 3B, the timing of reverse rotation of the conveyance roller 10 for activating the clutch assembly to switch the rotation of the first and second output rollers 20 and 21 from reverse rotation to forward rotation is set to be a position upstream in the duplex transport passage (refeeding passage 97 and bypass passage 98) from a position at which, after once separated from the non-opposing surface 11*b* of the conveyance belt 11, the front end Pb of the single-side printed sheet P switched back is attached again to the opposing face 11*a* of the conveyance belt 11.

Such a configuration allows the charging for adhering the sheet P to the opposing face 11*a* of the conveyance belt 11 to be maintained at constantly refreshed state. In other words, if, when the front end Pb of the single-side printed sheet P switched back passes the position illustrated in FIG. 3B, the reverse rotation of the conveyance roller 10 is started to activate the clutch assembly to switch the rotation of the first and second output rollers 20 and 21 from reverse rotation to forward rotation, the sheet P once attached to the opposing face 11*a* of the conveyance belt 11 might be separated from the opposing face 11*a* of the conveyance belt 11 and attached again to the opposing face 11*a*. Such a configuration might disturb charging and considerably reduce the adhering force, thus causing irregular transport.

Hence, the first exemplary embodiment has a configuration in which, when the single-side printed sheet P switched back is attached to the non-opposing surface 11*b* of the conveyance belt 11 again, the sheet P is not placed on a portion of the opposing face 11*a* and the non-opposing surface 11*b* of the conveyance belt 11 which the sheet P is once attached to and separated from. Such a configuration allows the charging for attaching the sheet P to the opposing face 11*a* of the conveyance belt 11 to be maintained at constantly refreshed state.

As described above, according to the first exemplary embodiment, the first and second output rollers 20 and 21 (switchback device), the conveyance roller 10, and the conveyance belt 11 (conveyance device) can be driven by the single conveyance motor 9 (single driving source). In addition, sheet transport control in duplex printing can be performed at high precision without any additional actuator to the clutch control device 60 and the clutch pivoting device 61 (clutch assembly) to switch the forward and backward rotations of the first and second output rollers 20 and 21. For the driving system according to the first exemplary embodiment, since a clutch, e.g., pivoting gear, is not provided in the driving system, the driving stiffness of the driving system can be normally maintained without being reduced. Even if high frequency voltage is input to drive the conveyance motor 9 formed with a DC motor, the DC motor can be normally activated without oscillation or increase in time constant, thus allowing high speed transport and high precision control of sheet transport amount of the conveyance belt 11.

Second Exemplary Embodiment

A second exemplary embodiment of this disclosure is described with reference to FIGS. 6A, 6B, 7A, and 7B.

Figure 6A:
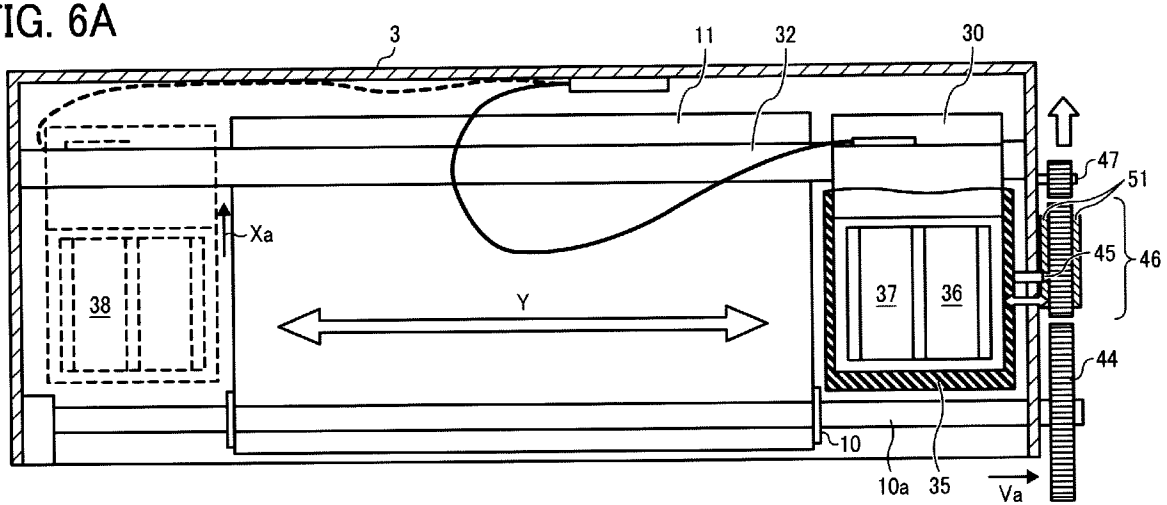
FIG. 6A is a schematic partially cross-sectional side view of a clutch assembly according to a second exemplary embodiment, a carriage to activate the clutch assembly, and a driving-force transmission assembly from a driving system to an output-and-reversal section.
Figure 6B:
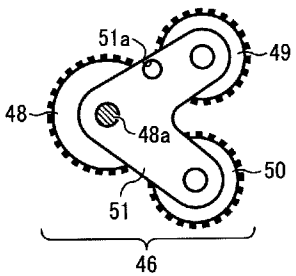
FIG. 6B is a schematic partial cross-sectional front view of a pivoting gear unit forming art of the clutch assembly according to the second exemplary embodiment.
Figure 7B:
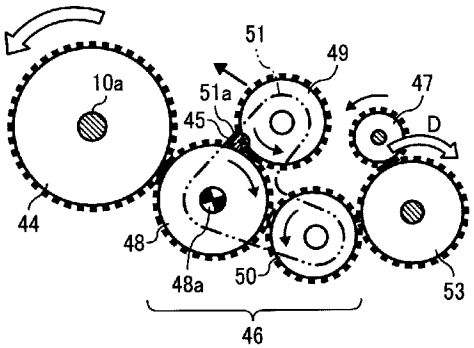
FIGS. 7A and 7B are schematic partial cross-sectional front views of the pivoting gear unit of FIG. 6B and surrounding parts.
Figure 7A:
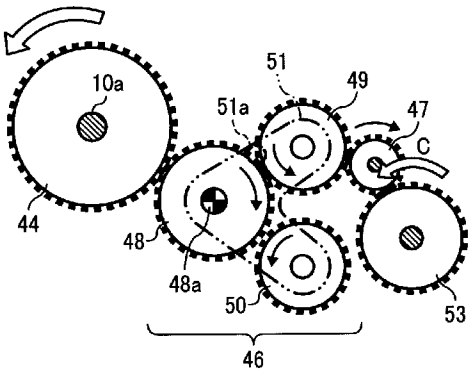

FIGS. 6A and 6B show a position of a carriage to switch the rotation direction of a clutch assembly and a switchback device. FIGS. 7A and 7B show operation of the clutch assembly (pivoting gear unit). FIGS. 6B, 7A, and 7B are partially cross-sectional side views of the clutch assembly seen from a direction indicated by an arrow Va in FIG. 6A.

The second exemplary embodiment differs from the first exemplary embodiment illustrated in FIGS. 1 to 5C in that the clutch assembly illustrated in FIGS. 6 and 7 is used instead of the clutch assembly according to the first exemplary embodiment illustrated in FIGS. 4A to 5C, and a driving system including a single conveyance motor rotatable only in forward direction is used instead of the driving system including the conveyance motor 9 rotatable in forward and reverse directions illustrated in FIGS. 4A and 4B. The configuration of the second exemplary embodiment is substantially the same as the configuration of the first exemplary embodiment except for the above-described differences. In other words, the conveyance roller 10 in this second exemplary embodiment rotates only in forward direction, and travels and circulates only in the belt traveling direction Xa with the forward rotation of the conveyance roller 10.

The clutch assembly in this second exemplary embodiment has a pivoting gear unit 46 and a pivoting gear regulation member 45 serving as a pivoting gear regulation mechanism.

The clutch assembly according to this second exemplary embodiment (hereinafter, referred to as simply "the clutch assembly" in descriptions of the second exemplary embodiment) has a function and configuration to activate the clutch assembly in accordance with the position of a carriage 30 serving as a moving body movable with the operation of an image forming device (recording head 31) during non image formation to change the rotation direction of first and second output rollers 20 and 21. Thus, the position of the carriage 30 serving as the moving body movable with the operation of the image forming device during non image formation serves as activation means to activate the clutch assembly of this exemplary embodiment.

In FIG. 6A, a body frame 3 serves as apparatus body to mount and hold a main guide rod 32 and other members. As illustrated in FIG. 6A, each end of a shaft 10*a* of a conveyance roller 10 is rotatably supported by the body frame 3. A conveyance roller gear 44 is fixed at an end portion of the shaft 10*a* of the conveyance roller 10 (right end portion in FIG. 6A). The pivoting gear unit 46 has a driving gear 48 constantly engaging the conveyance roller gear 44, a first pivoting gear 49 constantly engaging the driving gear 48, a second pivoting gear 50 constantly engaging the driving gear 48, and a pair of opposed connection arms 51 rotatably supporting the driving gear 48, the first pivoting gear 49, and the second pivoting gear 50 via respective gear shafts. The pivoting gear unit 46 is pivotable around a gear shaft 48*a* of the driving gear 48 rotatably supported by the body frame 3. Of the pair of opposed connection arms 51, an inner connection arm 51 has an engagement through hole 51*a* to selectively engage the pivoting gear regulation member 45.

At a position near the first pivoting gear 49 of the pivoting gear unit 46, an intermediate gear 47 selectively engaging the first pivoting gear 49 is rotatably supported by the body frame 3 via a gear shaft. The intermediate gear 47 is disposed so as to constantly engage a drive passing gear 53 rotatably supported by the body frame 3 via the gear shaft. The drive passing gear 53 is connected to a driving assembly of the sheet output section (see the first output roller gear 20A and the second output roller gear 21A illustrated in FIG. 4) via a driving force transmission device including, e.g., a gear train. The pivoting gear regulation member 45 has a round rod of metal having, e.g., a tapered front end portion to achieve an automatic core adjustment function. As illustrated in FIG. 6A, a base end portion of the pivoting gear regulation member 45 is fixed at a right-side outer wall of the carriage 30. As illustrated in FIG. 7A, when the front end portion of the pivoting gear regulation member 45 is not engaged with the engagement through hole 51*a* of the inner connection arm 51, the pivoting gear unit 46 is placed at a gear connecting position illustrated in FIG. 7A by the urging force of a spring. In other words, gears of the pivoting gear unit 46 are connected so as to rotate the first and second output rollers 20 and 21 in the forward direction.

Here, a maintenance device of the inkjet printer 100 is further described.

In FIG. 6A, at non-print (non-image formation) areas on both ends in the main scanning direction of the carriage 30 indicated by an arrow Y, a maintenance device 35 (maintenance-and-recovery module) to maintain and recover conditions of nozzles of the recording head 31. The maintenance device 35 includes caps 36 to cover a nozzle face of the recording head 31 for suction and moisture retention, a wiper blade 37 to wipe the nozzle face of the recording head 31, and a droplet receptacle 38 to receive liquid droplets discharged during maintenance ejection in which liquid droplets not contributing to a recorded image are discharged to remove, e.g., viscosity-increased recording liquid.

In printing or waiting for the next printing (recording) operation, the carriage 30 is moved to a position above the maintenance device 35 and the nozzle face of the recording head 31 is covered with the cap 36. Thus, the moisture in the nozzles is kept to prevent an ejection failure due to ink drying. With the nozzle face of the recording head 31 covered with the cap for suction, recording liquid (ink) is sucked from the nozzles of the recording head 31 to perform recovery operation to remove viscosity-increased liquid or air bubbles. In addition, before or during recording operation, the above-described maintenance ejection is performed to discharge ink not contributing to a recorded image, thus maintaining stable ejection performance of the recording head 31.

Next, operation of the clutch assembly according to this exemplary embodiment is described below.

FIG. 7A shows a connection state of gears in the forward rotation of the first and second output rollers 20 and 21 (output operation of a single-side printed sheet P). In such a state, the pivoting gear regulation member 45 does not regulate the pivoting gear unit 46, and the first pivoting gear 49 of the pivoting gear unit 46 engages and is connected to the intermediate gear 47 by the weight and rotation torque (transmitted from a conveyance roller 44) of the pivoting gear unit 46 and the urging force of spring. At this time, as illustrated in FIG. 7A, the drive transmission gear 53 to transmit the driving force to the sheet output side rotates counterclockwise (performs left-handed rotation) as indicated by an arrow C.

By contrast, FIG. 7B shows a connection state of the gears in the reverse rotation of the first and second output rollers 20 and 21 (switchback operation). In such a state, as illustrated in FIG. 6A, by the movement of the carriage 30 to the position above the maintenance device 35 in the main scanning direction Y, the front end portion of the pivoting gear regulation member 45 is inserted into the engagement through hole 51*a* of the inner connection arm 51 of the pivoting gear unit 46 for engagement. As a result, the pivoting gear unit 46 is pivoted counterclockwise around the gear shaft 48*a* for displacement and is pushed upward. Thus, the driving is switched, and as illustrated in FIG. 7B, the drive transmission gear 53 to transmit the driving force to the sheet output side rotates clockwise (performs right-handed rotation) as indicated by an arrow D.

In the state of FIG. 7B, when the carriage 30 moves from the maintenance device 35 to the recording area in the main scanning direction Y to perform printing (image forming) operation, the engagement state of the pivoting gear regulation member 45 and the engagement through hole 51*a* of the inner connection arm 51 is released. By the urging force of the spring, the pivoting gear unit 46 is placed at the gear connecting position illustrated in FIG. 7A and the gears are connected so that the first and second output rollers 20 and 21 rotate forward. Using the above-described driving system and clutch assembly allows control of forward and reverse rotation of the first and second output rollers 20 and 21 serving as switchback device.

The configuration of pivotingly displacing the pivoting gear unit 46 is not limited to the above-described engagement of the pivoting gear regulation member 45 and the engagement through hole 51*a* of the inner connection arm 51. For example, a combination of a rod-shaped pressing member fixed at the right-side outer wall of the carriage 30 and a slanted plate having a slanted face fixed at the inner connection arm 51 and selectively engageable with the pressing member or any other equivalent means may be used to pivotingly displace the pivoting gear unit 46.

Next, operation of the clutch assembly according to the second exemplary embodiment mainly in duplex printing is described with reference to FIGS. 2A to 3B and 6A to 7B.

After simplex printing is performed in the above-described manner, when a front end Pa of the single-side printed sheet P is guided to the respective nipping portions of the first and second output rollers 20 and 21 and a rear end Pb of the single-side printed sheet P passes the branching section (the area at which the branching claw 25 is disposed) of the output-and-reversal section 93 (see FIG. 2A). When the single-side printed sheet P is placed at a switchback position, a sensor detects that the rear end Pb of the single-side printed sheet P has passed the branching section. As a result, the transport of the single-side printed sheet P is temporarily stopped. At this time, the drive switching of the first and second output rollers 20 and 21 from forward rotation to reverse rotation is performed by the clutch assembly according to the second exemplary embodiment. In other words, the carriage 30 movable with an operation of the recording head 31 during non image formation moves to a right-side end illustrated in FIG. 6A, and as a result, the front end portion of the pivoting gear regulation member 45 is inserted into and engaged with the inner connection arm 51 against the urging force of the spring. Thus, from the gear connection state illustrated in FIG. 7A, the pivoting gear unit 46 is pivotingly displaced counterclockwise around the gear shaft 48*a* and turned into the gear connection state illustrated in FIG. 7B. As a result, the driving is switched, and as illustrated in FIG. 7B, the drive transmission gear 53 to transmit the driving force to the sheet output side rotates clockwise (performs right-handed rotation) as indicated by the arrow D, thus causing the first and second output rollers 20 and 21 to rotate in reverse.

As described above, in a case in which the sheet output section or the sheet output and reversal section has the first and second output rollers 20 and 21 serving as switchback device, the switchback position of the single-side printed sheet P is set to a position to which the sheet is transported at a certain amount after an image is printed on a first face of the sheet. In other words, since the carriage 30 is in standby state after the end of printing of the first face, the carriage 30 can perform maintenance operation and any other operation than direct printing operation. Thus, the position of the carriage 30 to activate the clutch assembly to switch back the sheet is disposed near an area in which maintenance operation is performed. Such a configuration has an advantage in which a relatively small movement range of the carriage 30 can be set. In other words, only when the carriage 30 is placed within a certain range, the clutch for rotating the first and second output rollers 20 and 21 in reverse is engaged. As a result, when the carriage 30 moves to a position outside the certain range near the maintenance device 35, the first and second output rollers 20 and 21 rotate forward again.

In other words, when the carriage 30 is placed within the certain range near the maintenance device 35, the first and second output rollers 20 and 21 always perform reverse rotation. By contrast, when the carriage 30 is placed outside the certain range near the maintenance device 35, the first and second output rollers 20 and 21 always perform forward rotation.

Once the carriage 30 lets in the clutch, the first and second output rollers 20 and 21 continue the reverse rotation unless the clutch is released. Such a configuration is advantageous, e.g., when the carriage 30 needs to operate at multiple places away from each other during reverse rotation of the first and second output rollers 20 and 21. The maintenance operation of the carriage 30 may be performed during the switchback operation in duplex printing, thus removing operational waste without reducing productivity. Thus, the above-described configuration is advantageous, for example, in a case in which two or more of sucking operation of the recording head 31, cleaning operation of the recording head 31, maintenance ejection, ink supply operation of supplying ink to the recording head 31 of the carriage 30 are performed at positions away from one another.

However, for the above-described configuration, since it is not clearly recognizable whether the clutch is turned on or off based on the position of the carriage 30, a user may not see the rotation direction of the first and second output rollers 20 and 21 in a case in which the apparatus goes down due to an error and then recovers. In such a case, on and off positions of the clutch for reverse rotation may be different from each other. Such a configuration allows recovery operation to be performed after the carriage 30 turns the clutch on or off (the rotation direction of the first and second output rollers 20 and 21 is made clear).

Next, a configuration of activating the clutch assembly to switch the rotation direction of the first and second output rollers 20 and 21 from reverse rotation to forward rotation is described below with reference to FIGS. 3A and 3B.

Switching the rotation direction of the first and second output rollers 20 and 21 from reverse rotation to forward rotation need be performed after the rear end Pa of the single-side printed sheet P switched back enters the duplex transport passage (refeeding passage 97) and the rear end Pa of the sheet P passes the switchback device, i.e., the first output roller 20. Before the rear end Pa of the sheet P passes the first output roller 20, a rear end portion of the sheet P is sandwiched at the nipping portion between the first output roller 20 and the spur 16*c*. In such a state, if the rotation direction of the first and second output rollers 20 and 21 is switched from reverse rotation to forward rotation, the sheet P is undesirably pushed back toward the upstream side of the duplex transport passage (refeeding passage 97) from a state in which the sheet P is conveyed in the belt traveling direction Xa with a front end side of the sheet P attached on the conveyance belt 11 by static electricity. In other words, the timing of switching the rotation direction of the first and second output rollers 20 and 21 from reverse rotation to forward rotation need be set so as to meet the relationship between the position of the rear edge Pa of the single-side printed sheet P and the sheet transport amount 67.

As described above, the timing at which the first and second output rollers 20 and 21 are returned to the forward rotation can be set within a relatively long period and thus adjustable to an operation of the carriage 30 (e.g., sucking operation of the recording head 31, cleaning operation of the recording head 31, maintenance ejection, and ink supply operation of supplying ink to the recording head 31 of the carriage 30).

However, activating the clutch assembly during printing operation (from the start to the end of printing on the second face of sheet) is not preferable since the clutch assembly is connected to the conveyance roller 10 to drive the conveyance roller 10. In addition, since the carriage 30 moves to a printing area during printing operation, moving the carriage 30 to the clutch position could reduce productivity. Thus, actually, when the sheet P is placed upstream from the position illustrated in FIG. 3B, the first and second output rollers 20 and 21 are preferably returned to the forward rotation.

As described above, according to the second exemplary embodiment, the first and second output rollers 20 and 21 (switchback device), the conveyance roller 10, and the conveyance belt 11 (conveyance device) can be driven by the single conveyance motor 9 (single driving source). In addition, sheet transport control in duplex printing can be performed at high precision without any additional actuator to the pivoting gear unit 46 and the pivoting gear regulation member 45 (clutch assembly) serving as the pivoting gear regulation mechanism to switch the forward and backward rotations of the first and second output rollers 20 and 21.

For the driving system according to the second exemplary embodiment, since a clutch, e.g., a pivoting gear is not intermediately provided in the driving system, the driving stiffness of the driving system can be normally maintained without being reduced. Even if high frequency voltage is input to drive the conveyance motor 9 formed with a DC motor, the DC motor can be normally activated without oscillation or increase in time constant, thus allowing high speed transport and high precision control of sheet transport amount of the conveyance belt 11.

Figure 8:
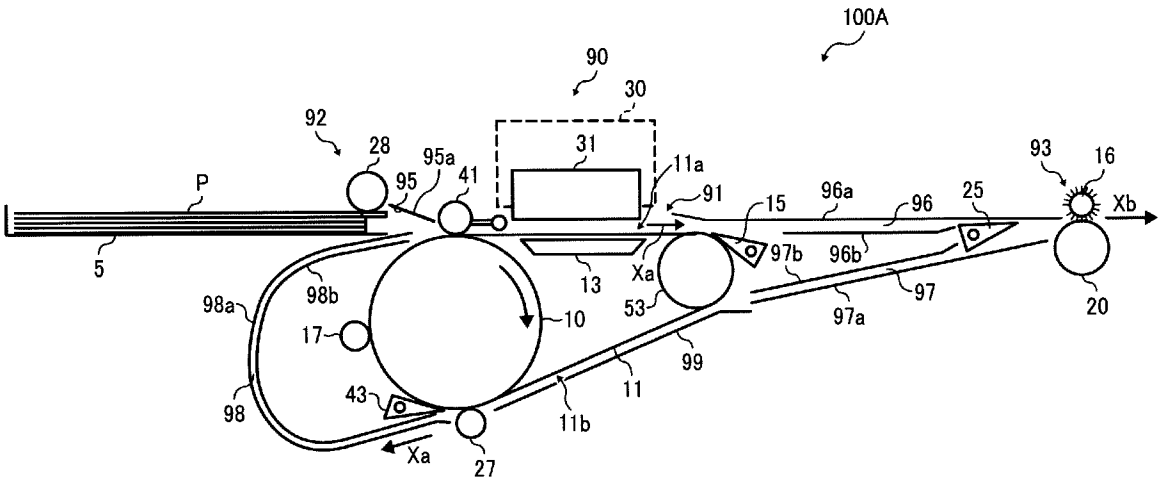
FIG. 8 is a schematic front view of an example of an image forming apparatus according to an exemplary embodiment of this disclosure.

A variation of the first and second exemplary embodiments of this disclosure is described with reference to FIG. 8.

The variation differs from the above-described exemplary embodiments mainly in that an inkjet printer 100A serving as an example of an image forming apparatus having a different layout configuration than the inkjet printer 100 illustrated in FIG. 1 is used in the variation. Even if elements (members or components) of the inkjet printer 100A illustrated in FIG. 8 are slightly different in shape from the elements of the inkjet printer 100 illustrated in FIG. 1, the same reference characters are allocated to elements (members or components) of the inkjet printer 100A of FIG. 8 having the same functions as those of the inkjet printer 100 of FIG. 1 and redundant descriptions thereof are omitted below.

The inkjet printer 100A differs from the inkjet printer 100 of FIG. 1 mainly in the following points. First, the inkjet printer 100A employs a horizontal sheet feed path instead of the vertical sheet feed path of the inkjet printer 100. Second, in connection with the first difference, a vertical printing method of the recording head 31 mounted on the carriage 30 indicated by a broken line is employed instead of the horizontal printing method (and in connection with this second difference, the sheet is output to the sheet output tray with the printed face up). Third, the sheet output device and the switchback device are formed with a single sheet output roller 20 and a single spur 16.

Minor differences other than the above-described differences are as follows.

In the inkjet printer 100A, a conveyance guide plate 13 opposing the recording head 31 of the carriage 30 and extending in the main scanning direction is defined at the back-face (inner-face) side of an opposing face 11*a* of the conveyance belt 11. In addition, a sheet feed transport passage 95 of the inkjet printer 100A is formed with a sheet-feed guide member 95*a*, and a common transport passage 96 is formed with a pair of guide members 96*a* and 96*b*. Furthermore, a refeeding passage 97 of the inkjet printer 100A is formed with a pair of guide members 97*a* and 97*b*, and a belt guide member 99 is disposed along the non-opposing surface 11*b* of the conveyance belt 11. A bypass passage 98 of the inkjet printer 100A is formed with a pair of guide members 98*a* and 98*b*.

Even in a case in which the clutch assembly according to any of the above-described first and second exemplary embodiments is employed, one ordinary skilled in the art can easily understand and execute operations of the inkjet printer 100A based on the above-described operations of the inkjet printer 100. Therefore, redundant descriptions of the operations of the inkjet printer 100A are omitted below.

Although the first and second exemplary embodiments and its variation are described above, it is to be noted that the art disclosed in the present disclosure is not limited to the above-described exemplary embodiments and its variation but, for example, the above-described exemplary embodiments and its variation may be appropriately combined. It will be obvious for one of ordinal skill in the art that, in light of the above teachings, different exemplary embodiments and variations are possible according to need and use.

The image forming apparatus recited in appended claims is not limited to the above-described inkjet printer 100 or 100A according to any of the first and second exemplary embodiments and its variation but may be applicable to an electrophotographic image forming apparatus like that described in, for example, JP-2006-232440-A.

The image forming apparatus recited in appended claims is not limited to the above-described inkjet printer 100 or 100A according to any of the first and second exemplary embodiments and its variation. For example, a conveyance belt having a suction hole like those described in JP-H5-107969-A and JP-H10-291709 may be used instead of the conveyance belt 11 of electrostatic attraction type. In such a case, a fan having both suction and air blow functions may be provided so that the sucking direction of the fan is controlled on the opposing face and the non-opposing face of the conveyance belt.

The image forming apparatus recited in appended claims is not limited to the above-described inkjet printer 100 or 100A according to any of the first and second exemplary embodiments and its variation but is applicable to, for example, an image forming apparatus including an inkjet recording apparatus in, for example, a printer, a plotter, a word processor, a facsimile machine, a copier, a mimeograph apparatus, or a multi-functional device having two or more of the foregoing capabilities.

In addition, the image forming apparatus recited in appended claims is not limited to the above-described serial-type inkjet printer 100 or 100A according to any of the first exemplary embodiment and its variation but the clutch assembly according to the first exemplary embodiment is applicable to, for example, a line-head-type inkjet recording apparatus. Furthermore, recording media or sheets are not limited to the sheets P but may be thin to thick sheets, postcards, envelope, OHP sheets, or any other type of recording media or sheets on which images can be formed.

What is claimed is:

1. An image forming apparatus, comprising:

a conveyance device to convey a sheet of recording media;

an image forming device disposed opposing the conveyance device to form an image on the sheet conveyed by the conveyance device;

a switchback device rotatable in forward and reverse directions and disposed downstream from the conveyance device to switch back the sheet after the image forming device forms an image on a first face of the sheet on an opposing surface of the conveyance device opposing the image forming device;

a refeeding device to refeed, toward the image forming device again, the sheet switched back by reverse rotation of the switchback device;

a reverse path to guide the sheet refed by the refeeding device to a non-opposing surface of the conveyance device opposite to the opposing surface, reverse the sheet, and guide the sheet to the opposing surface of the conveyance device again;

a single driving source to drive the conveyance device and the switchback device;

a driving assembly to transmit driving force of the driving source to the conveyance device;

a clutch assembly disposed at a position other than the driving assembly to switch rotation of the switchback device between forward rotation and reverse rotation; and an activation device to activate the clutch assembly to switch rotation of the switchback device between forward rotation and reverse rotation, wherein each of the driving source and the conveyance device is rotatable in forward and reverse directions, the conveyance device serves as the activation device, and the clutch assembly is activated by a certain amount of reverse rotation of the conveyance device to switch rotation of the switchback device between forward rotation and reverse rotation, and wherein the conveyance device has a conveyance belt looped around at least two rotary members for circulation to convey the sheet with the sheet attached on the conveyance belt, the refeeding device refeeds and guides the sheet switched back to a belt surface of the conveyance belt at a non-opposing side of the conveyance belt not opposing the image forming device, the reverse path guides the sheet so that the sheet is attracted again on the belt surface of the conveyance belt at an opposing side of the conveyance belt opposing the image forming device after the sheet is once separated from the belt surface of the conveyance belt at the non-opposing side, and when a front end of the sheet switched back is placed at a position of the reverse path upstream from a position at which the front end of the sheet is attracted on the belt surface of the conveyance belt at the opposing side again after the front end is once separated from the conveyance belt at the non-opposing side, the conveyance device is rotated in reverse to activate the clutch assembly to switch rotation of the switchback device from reverse rotation to forward rotation.

2. The image forming apparatus of claim 1, further comprising:

a transport path switching device to switch, to the reverse path, a transport path of the sheet switched back by the switchback device; and a rotary body disposed at a most upstream side of the non-opposing surface of the conveyance device in the reverse path and rotatable while pressing the sheet switched back by the switchback device against the non-opposing surface of the conveyance device, wherein, when the clutch assembly is activated by the certain amount of reverse rotation of the conveyance device to switch rotation of the switchback device from forward rotation to reverse rotation, the certain amount is set to be not greater than a transport amount of the sheet from a position at which a rear end of the sheet passes the transport path switching device to a position at which a front end of the sheet contacts the rotary body.

3. The image forming apparatus of claim 1, wherein the certain amount of reverse rotation of the conveyance device is set to be different between when the clutch assembly is activated by the certain amount of reverse rotation of the conveyance device to switch rotation of the switchback device from forward rotation to reverse rotation and when the clutch assembly is activated by the certain amount of reverse rotation of the conveyance device to switch rotation of the switchback device from reverse rotation to forward rotation.

4. The image forming apparatus of claim 1, wherein, when the clutch assembly is activated by the certain amount of reverse rotation of the conveyance device to switch rotation of the switchback device from reverse rotation to forward rotation, the certain amount of reverse rotation of the conveyance device is set to be not greater than a transport amount of the sheet from a position at which a rear end of the sheet switched back passes a sandwiching portion of the switchback device to a position at which the sheet passes the transport path switching device.

5. The image forming apparatus of claim 1, wherein, when the conveyance device rotates in reverse, the driving force of the driving source is not transmitted to the switchback device.

6. The image forming apparatus of claim 1, wherein the clutch assembly comprises a clutch control device connected to the conveyance device, and a clutch pivoting device connected to the conveyance device and the switchback device and pivotably disposed to detachably engage the clutch control device, and the clutch pivoting device is pivoted by the certain amount of reverse rotation of the conveyance device to engage the clutch control device to switch rotation of the switchback device between forward rotation and reverse rotation.

7. The image forming apparatus of claim 1, wherein the activation device is a moving body movable with the image forming device, and by a movement of the moving body to a position with an operation of the image forming device during non image formation, the clutch assembly is activated to switch rotation of the switchback device between forward rotation and reverse rotation.

8. The image forming apparatus of claim 7, wherein, when the moving body is placed within a certain range, the clutch assembly is activated to rotate the switchback device in reverse.

9. The image forming apparatus of claim 7, wherein on and off states of the clutch assembly are switched in accordance with the position of the moving body to rotate the switchback device in reverse.

10. The image forming apparatus of claim 7, wherein the position of the moving body is different between when the clutch assembly is turned to on state to rotate the switchback device in reverse and when the clutch assembly is turned to off state.

11. The image forming apparatus of claim 1, wherein, during non image forming operation in which the image forming device does not form an image on the sheet, conveyance speed of the conveyance device is set to be faster than during image forming operation in which the image forming device forms an image on the sheet.

12. An image forming apparatus, comprising:

conveying means for conveying a sheet of recording media;

image forming means for forming an image on the sheet conveyed by the conveying means;

switchback means for switching back the sheet at a position downstream from the conveying means after the image forming means forms an image on a first face of the sheet on an opposing surface of the conveying means opposing the image forming means, the switchback means being rotatable in forward and reverse directions;

refeeding means for refeeding, toward the image forming means again, the sheet switched back by reverse rotation of the switchback means;

a reverse path to guide the sheet refed by the refeeding means to a non-opposing surface of the conveying means opposite to the opposing surface, reverse the sheet, and guide the sheet to the opposing surface of the conveying means again;

a single driving source to drive the conveying means and the switchback means;

a driving assembly to transmit driving force of the driving source to the conveying means;

a clutch assembly disposed at a position other than the driving assembly to switch rotation of the switchback means between forward rotation and reverse rotation; and activating means for activating the clutch assembly to switch rotation of the switchback means between forward rotation and reverse rotation, wherein each of the driving source and the conveying means is rotatable in forward and reverse directions, the conveying means serves as the activating means, and the clutch assembly is activated by a certain amount of reverse rotation of the conveying means to switch rotation of the switchback means between forward rotation and reverse rotation, and wherein the conveying means has a conveyance belt looped around at least two rotary members for circulation to convey the sheet with the sheet attached on the conveyance belt, the refeeding means refeeds and guides the sheet switched back to a belt surface of the conveyance belt at a non-opposing side of the conveyance belt not opposing the image forming means, the reverse path guides the sheet so that the sheet is attracted again on the belt surface of the conveyance belt at an opposing side of the conveyance belt opposing the image forming means after the sheet is once separated from the belt surface of the conveyance belt at the non-opposing side, and when a front end of the sheet switched back is placed at a position of the reverse path upstream from a position at which the front end of the sheet is attracted on the belt surface of the conveyance belt at the opposing side again after the front end is once separated from the conveyance belt at the non-opposing side, the conveying means is rotated in reverse to activate the clutch assembly to switch rotation of the switchback means from reverse rotation to forward rotation.

* * * * *